US008974025B2

(12) United States Patent
Kitada et al.

(10) Patent No.: US 8,974,025 B2
(45) Date of Patent: Mar. 10, 2015

(54) INK JET RECORDING APPARATUS

(71) Applicant: Seiko Epson Corporation, Tokyo (JP)

(72) Inventors: Kenji Kitada, Matsumoto (JP); Shinichi Kato, Matsumoto (JP); Yoshinobu Sato, Osaka (JP); Hiroshi Sawada, Osaka (JP); Hirotoshi Koyano, Osaka (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/308,195

(22) Filed: Jun. 18, 2014

(65) Prior Publication Data

US 2014/0375715 A1 Dec. 25, 2014

(30) Foreign Application Priority Data

Jun. 19, 2013 (JP) ..... 2013-128236

(51) Int. Cl.
*B41J 2/15* (2006.01)
*B41J 2/045* (2006.01)

(52) U.S. Cl.
CPC ..... *B41J 2/04588* (2013.01)
USPC ..... 347/10; 347/11

(58) Field of Classification Search
None
See application file for complete search history.

(56) References Cited

U.S. PATENT DOCUMENTS

| | | | | |
|---|---|---|---|---|
| 8,308,257 | B2 * | 11/2012 | Matsushita et al. | 347/10 |
| 8,459,768 | B2 * | 6/2013 | Hasenbein et al. | 347/11 |
| 8,814,300 | B2 * | 8/2014 | Shin et al. | 347/10 |
| 2012/0225968 | A1 | 9/2012 | Nakano et al. | |

FOREIGN PATENT DOCUMENTS

| | | | |
|---|---|---|---|
| JP | 2007-090688 | A | 4/2007 |
| JP | 2012-149228 | A | 8/2012 |
| JP | 2013-155274 | A | 8/2013 |

* cited by examiner

*Primary Examiner* — Lamson Nguyen
(74) *Attorney, Agent, or Firm* — Nutter McClennen & Fish LLP; John J. Penny, V.

(57) ABSTRACT

An ink jet recording apparatus includes a liquid-ejecting head including a pressure-generating chamber filled with a photocurable ink composition containing a polymerizable functional group-containing compound and water, a nozzle communicating with the pressure-generating chamber and ejecting a droplet of the photocurable ink composition, and a pressure-generating member causing a pressure change in the pressure-generating chamber; and an ejection pulse-generating unit generating an ejection pulse for driving the pressure-generating member.

20 Claims, 5 Drawing Sheets

INK JET RECORDING APPARATUS

BACKGROUND

1. Technical Field

The present invention relates to an ink jet recording apparatus.

2. Related Art

Various systems have been utilized as recording methods of forming images on recording media such as paper based on image data signals. Among them, an ink jet system is an inexpensive apparatus and directly forms an image on a recording medium by discharging an ink composition only on a required image area and therefore efficiently uses ink compositions at low running cost. In addition, the ink jet system is low in noise and is therefore excellent as a recording method.

JP-A-2007-90688 discloses an ink jet recording apparatus performing image recording by discharging ink droplets from nozzles of a recording head, in which the object is to provide an ink jet recording apparatus having, for example, satisfactory discharge stability. The ink contains at least a coloring agent, water, and a polymer compound having a plurality of side chains on a hydrophilic main chain and capable of forming crosslinking between the side chains by irradiation with active energy rays. During the non-discharging time, the meniscus of the ink lying in a nozzle is minutely vibrated in such a manner that the ink droplets are not discharged from the nozzle. That is, the ink in a nozzle is stirred with minute vibration for achieving stable discharge.

However, in known methods including the method described in JP-A-2007-90688, an increase in the amount of a polymerizable compound in an ink composition containing water for enhancing the curing property increases the viscosity, resulting in a decrease in discharge stability, i.e., raises a problem of trade-off. This problem is significant in a case of forming a recorded matter having excellent image quality by discharging low-weight ink droplets and allowing ink dots having small sizes onto a recording medium at a high density. Specifically, in the discharge of ink droplets having a high viscosity and a low weight, the discharge speed of the ink droplets is apt to be slow, resulting in occurrence of curved flight, adhesion of ink mist to a nozzle plate, and dot omission. Accordingly, it has been demanded an ink jet recording apparatus that can solve the problem of trade-off between an improvement in curing property and an improvement in discharge stability.

SUMMARY

An advantage of some aspects of the invention is to provide an ink jet recording apparatus that can discharge a photocurable ink composition excellent in curing property with excellent discharge stability.

The present inventors have diligently studied and have found that an ink jet recording apparatus using predetermined ejection pulses can solve the above-mentioned problem and have accomplished the invention.

That is, the invention includes the following aspects:

[1] An ink jet recording apparatus comprising:

a liquid-ejecting head including a pressure-generating chamber filled with a photocurable ink composition containing a polymerizable functional group-containing compound and water, a nozzle communicating with the pressure-generating chamber and ejecting a droplet of the photocurable ink composition, and a pressure-generating member causing a pressure change in the pressure-generating chamber; and an ejection pulse-generating unit generating an ejection pulse for driving the pressure-generating member, wherein the ejection pulse includes:

a first voltage-changing factor expanding the volume of the pressure-generating chamber to pull a meniscus into the nozzle;

a second voltage-changing factor contracting the volume of the pressure-generating chamber to push the meniscus from the nozzle after the first voltage-changing factor;

a third voltage-changing factor causing a volume-expanding change for expanding the pressure-generating chamber after the second voltage-changing factor; and a fourth voltage-changing factor causing a volume-contracting change for contracting the pressure-generating chamber after the third voltage-changing factor, and the ink droplet is discharged from the nozzle by means of the ejection pulse;

[2] The ink jet recording apparatus according to aspect [1], wherein the second voltage-changing factor and the third voltage-changing factor respectively give a voltage variation ($\Delta Vhb$) and a voltage variation ($\Delta Vhc$) satisfying Expression (A): $\Delta Vhc/\Delta hb \geq 0.5$;

[3] The ink jet recording apparatus according to aspect [1] or [2], wherein the polymerizable functional group-containing compound has a content of 10% by mass or more based on 100% by mass of the photocurable ink composition;

[4] The ink jet recording apparatus according to any one of aspects [1] to [3], wherein the photocurable ink composition contains the polymerizable functional group-containing compound at least as an emulsion or as a polymerizable functional group-containing water-soluble compound;

[5] The ink jet recording apparatus according to any one of aspects [1] to [4], wherein the ejection pulse includes a third hold factor for holding the voltage of the third voltage-changing factor for a certain period of time between the third voltage-changing factor and the fourth voltage-changing factor; and the third hold factor has a holding time of 1.5 μs or less;

[6] The ink jet recording apparatus according to any one of aspects [1] to [5], wherein the first voltage-changing factor and the second voltage-changing factor respectively give a voltage variation ($\Delta Vha$) and a voltage variation ($\Delta Vhb$) satisfying Expression (B): $\Delta Vhb/\Delta ha \geq 0.7$;

[7] The ink jet recording apparatus according to any one of aspects [1] to [6], wherein the change in volume of the pressure-generating chamber by the third voltage-changing factor is smaller than the change in volume of the pressure-generating chamber by the first voltage-changing factor;

[8] The ink jet recording apparatus according to any one of aspects [1] to [7], wherein the ejection pulse includes a first hold factor for holding the voltage of the first voltage-changing factor for a certain period of time between the first voltage-changing factor and the second voltage-changing factor;

[9] The ink jet recording apparatus according to any one of aspects [1] to [8], wherein the ink droplet has a mass of 3.0 ng or less;

[10] The ink jet recording apparatus according to any one of aspects [1] to [9], wherein the ink droplet is discharged at a discharge speed of 3.0 m/s or more;

[11] The ink jet recording apparatus according to any one of aspects [1] to [10], wherein the ejection pulse has a frequency of 10 kHz or more;

[12] The ink jet recording apparatus according to any one of aspects [1] to [11], further comprising a heating member for heating a recording medium to which the ejected ink droplet adheres; and

[13] An ink jet recording method using an ink jet recording apparatus according to any one of aspects [1] to [12].

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
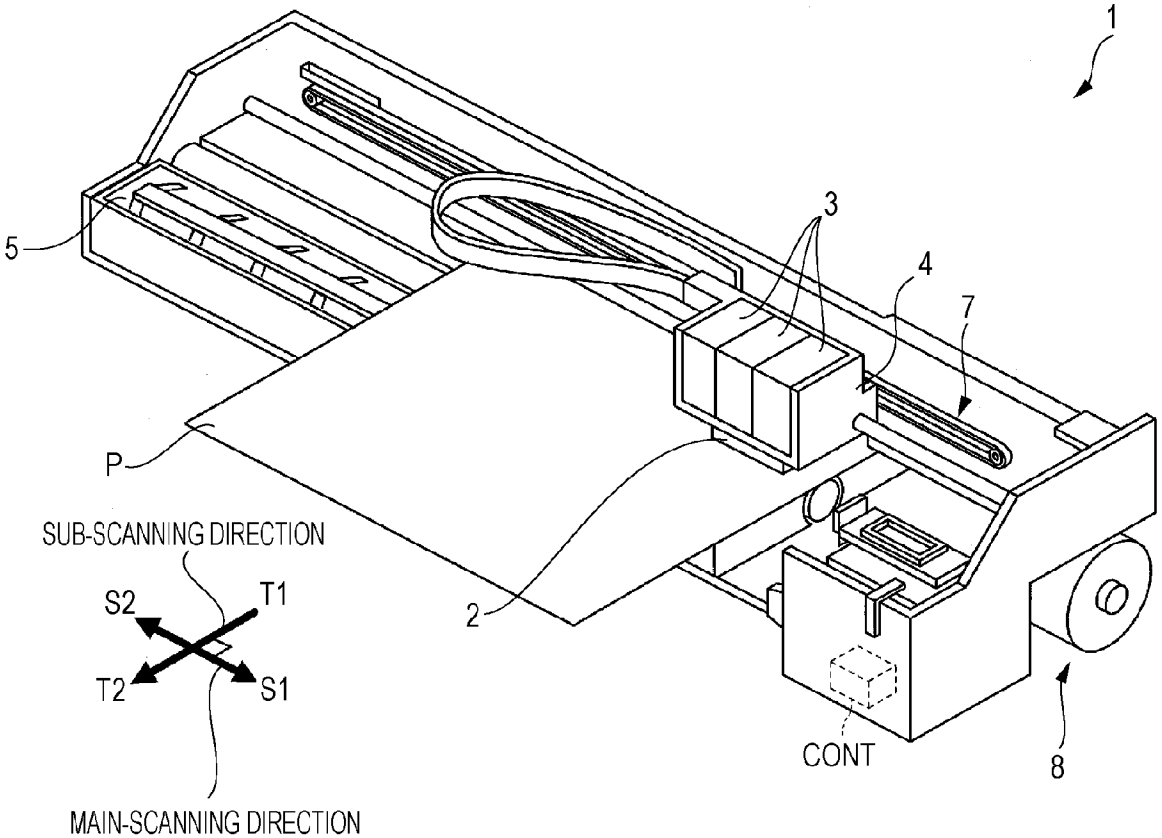
FIG. 1 is a perspective view of a printer according to an embodiment of the invention.
Figure 2:
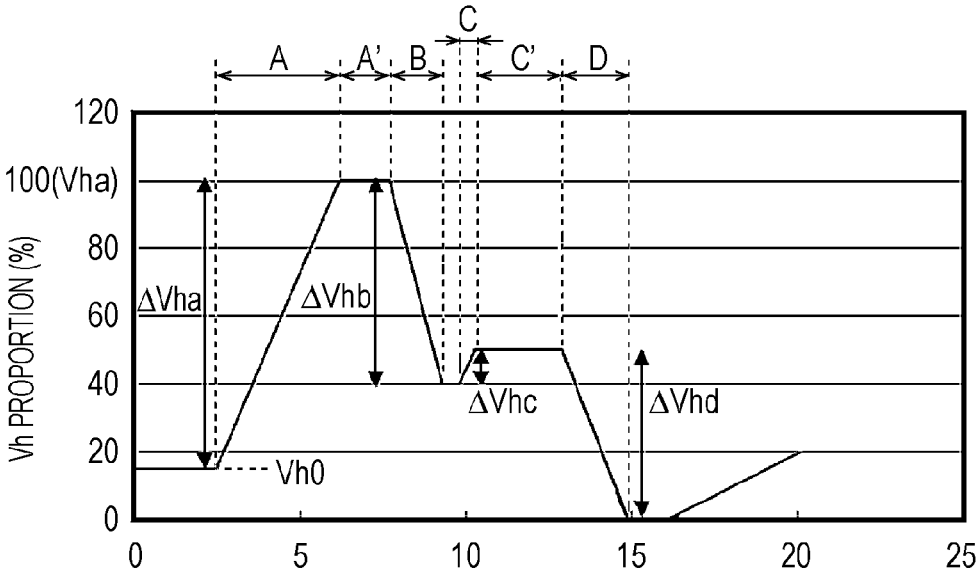
FIG. 2 is a graph showing ejection pulse 1 used in examples and comparative examples.
Figure 3:
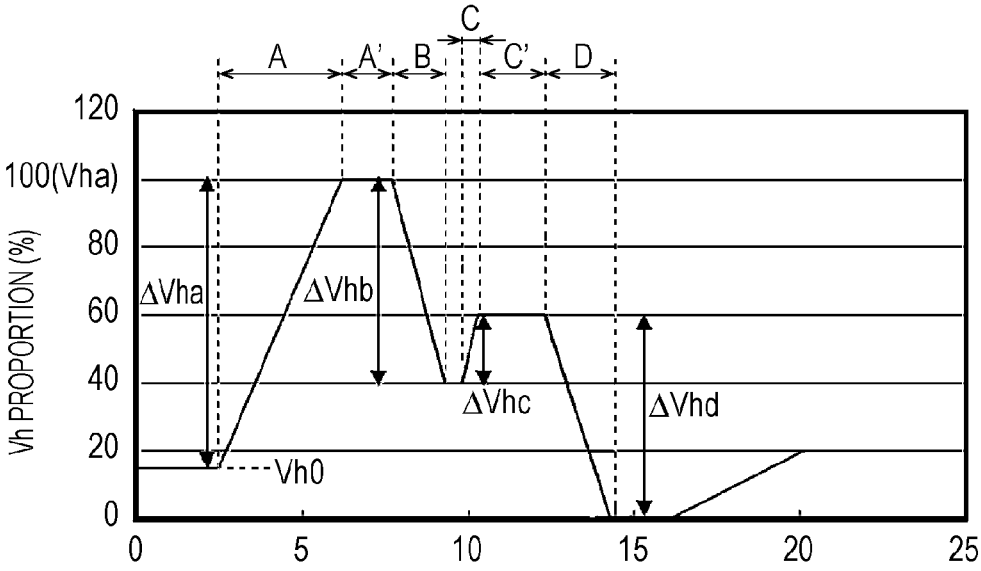
FIG. 3 is a graph showing ejection pulse 2 used in examples and comparative examples.
Figure 4:
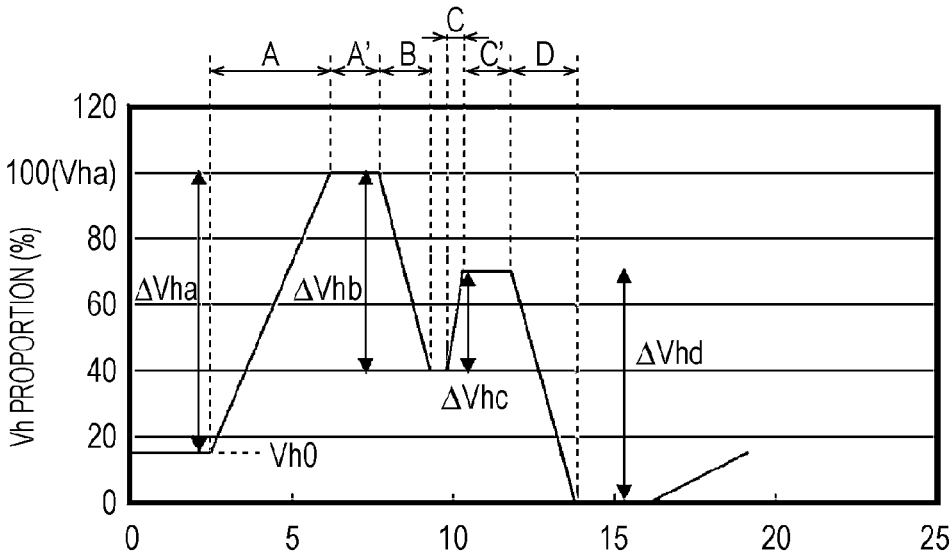
FIG. 4 is a graph showing ejection pulse 3 used in examples and comparative examples.
Figure 5:
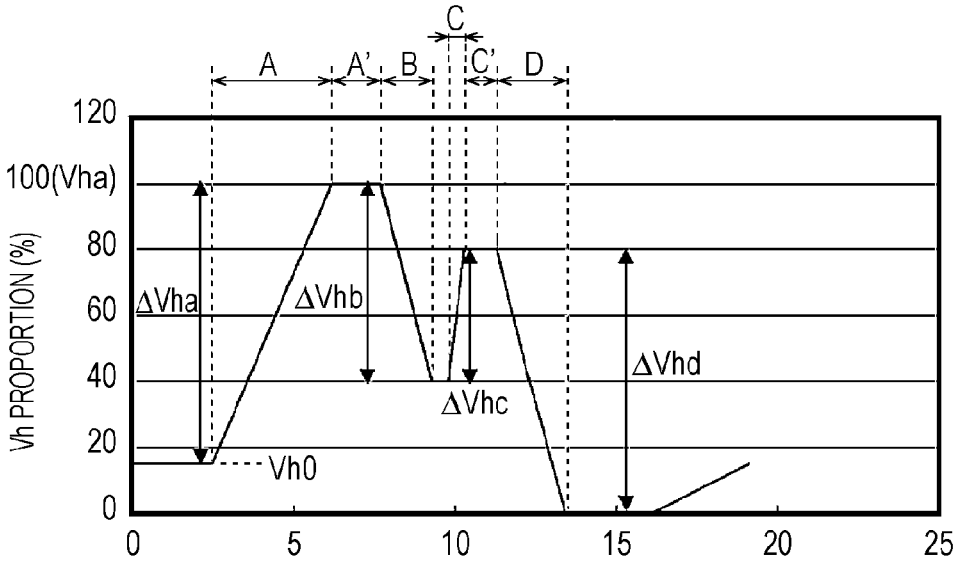
FIG. 5 is a graph showing ejection pulse 4 used in examples and comparative examples.
Figure 6:
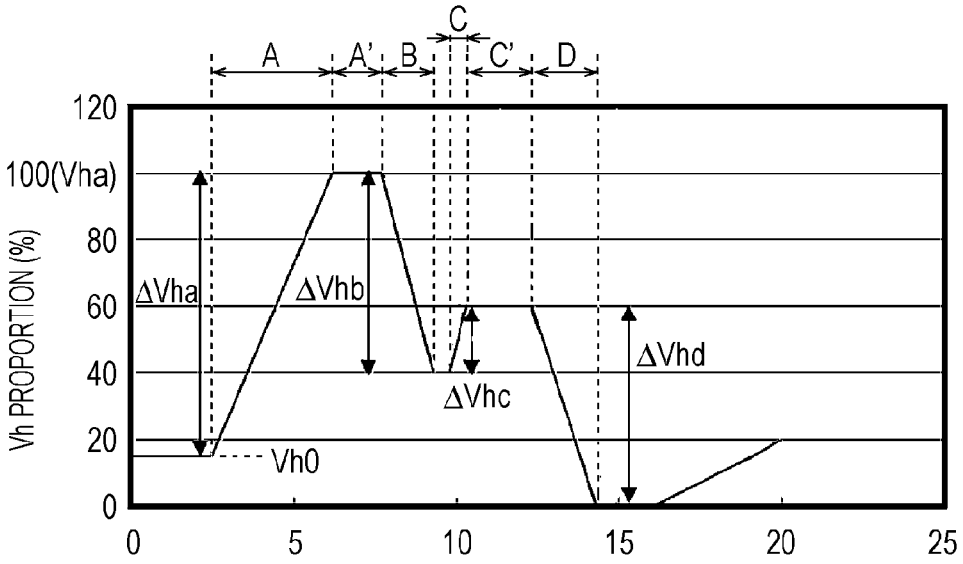
FIG. 6 is a graph showing ejection pulse 5 used in examples and comparative examples.
Figure 7:
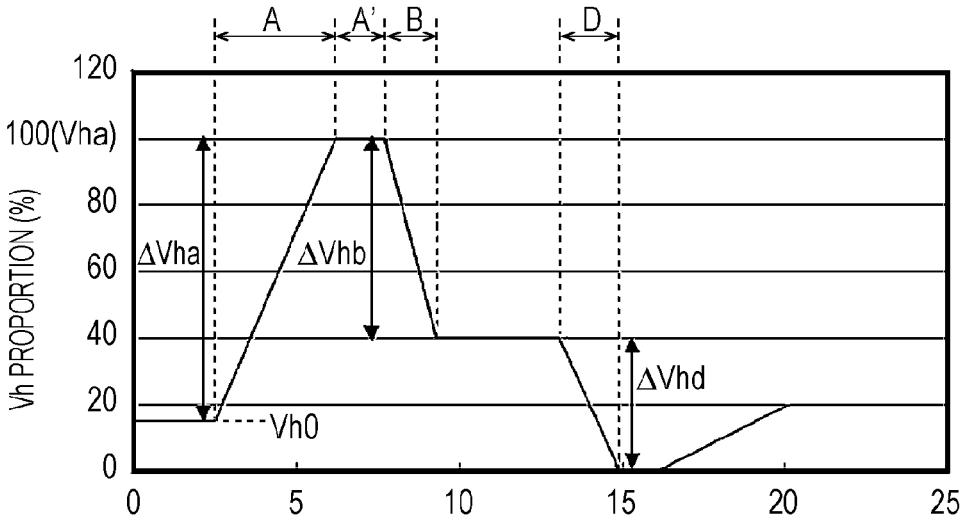
FIG. 7 is a graph showing ejection pulse 6 used in examples and comparative examples.
Figure 8:
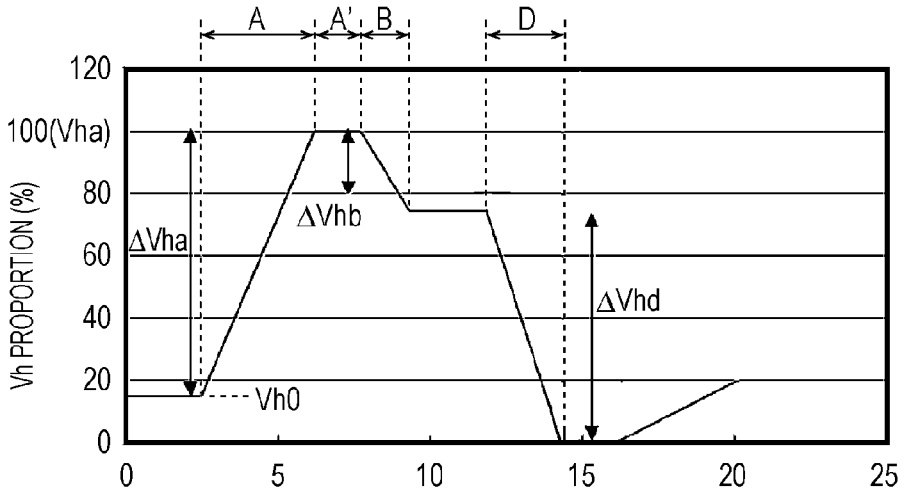
FIG. 8 is a graph showing ejection pulse 7 used in examples and comparative examples.

A configuration (hereinafter, referred to as "the embodiment") for implementing the invention will now be described in detail with reference to the drawings as necessary, but the invention is not limited thereto, and various modifications are possible within the gist of the invention. In the drawings, the same elements are denoted by the same reference signs, and the overlapping description is omitted. The positional relation such as up and down and right and left is based on the positional relation shown in the drawings, unless otherwise specified. The dimensional ratios are not limited to those shown in the drawings. Ink jet recording apparatus The ink jet recording apparatus according to the embodiment includes a liquid-ejecting head including a pressure-generating chamber filled with a photocurable ink composition (hereinafter, also referred to as "ink composition") containing a polymerizable functional group-containing compound and water, a nozzle communicating with the pressure-generating chamber and ejecting a droplet of the photocurable ink composition, and a pressure-generating member causing a pressure change in the pressure-generating chamber, and includes an ejection pulse-generating unit generating an ejection pulse for driving the pressure-generating member. The ejection pulse includes a first voltage-changing factor expanding the volume of the pressure-generating chamber to pull a meniscus into the nozzle, a second voltage-changing factor contracting the volume of the pressure-generating chamber to push the meniscus from the nozzle after the first voltage-changing factor, a third voltage-changing factor causing a volume-expanding change for expanding the pressure-generating chamber after the second voltage-changing factor, and a fourth voltage-changing factor causing a volume-contracting change for contracting the pressure-generating chamber after the third voltage-changing factor. The ink droplet is discharged from the nozzle by means of the ejection pulse.

FIG. 1 is a perspective view illustrating an example of the structure of a printer 1 used in the embodiment. The printer 1 shown in FIG. 1 is a serial printer. In the serial printer, a head is mounted on a carriage that moves in a predetermined direction, and liquid droplets are discharged onto a recording medium by moving the head with the movement of the carriage.

Figure 9:
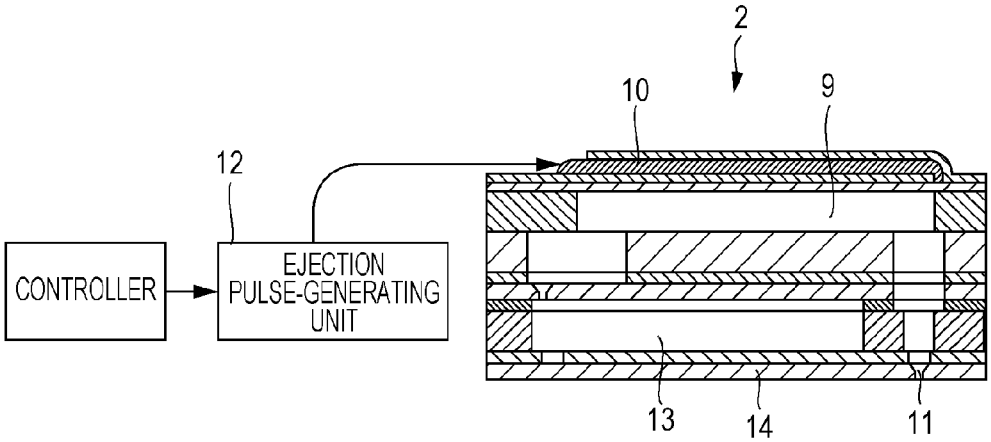
FIG. 9 is a schematic diagram illustrating a structure including the ejecting head according to an embodiment of the invention.

As shown in FIGS. 1 and 9, printer 1 includes a liquid-ejecting head 2, head device 3, a carriage 4 on which the liquid-ejecting head is mounted, a platen 5 disposed below the head 2 and onto which a recording medium P is transported, a carriage-moving mechanism 7 for moving the carriage 4 in the medium width direction of the recording medium P, and a medium-transporting mechanism 8 for transporting the recording medium P in the medium-transporting direction. The printer 1 includes a controller CONT that controls the entire operation of the printer 1 and an ejection pulse-generating unit 12 generating an ejection pulse for driving a pressure-generating member 10 of the liquid-ejecting head 2, described below, based on the control by the controller CONT. The medium width direction is the main-scanning direction (head scanning direction). The medium-transporting direction is the sub-scanning direction (direction orthogonal to the main-scanning direction). The head device 3 is a device relating to the head, such as a head-driving circuit. In the printer 1, ink cartridges (not shown) are detachably mounted on the printer 1 at a place other than the carriage 4.

In the printer 1 shown in FIG. 1, the photocurable ink composition contained in an ink cartridge is supplied to the liquid-ejecting head 2 from the head device 3 through an ink-supplying channel (not shown) and is discharged from the liquid-ejecting head 2 to a recording medium.

The controller CONT can control the timing of each operation of the carriage 4, head 2, carriage-moving mechanism 7, medium-transporting mechanism 8, etc. described above and also can make them cooperate.

Liquid-Ejecting Head

The liquid-ejecting head 2 includes a pressure-generating chamber 9 filled with a photocurable ink composition containing a polymerizable functional group-containing compound and water, a nozzle 11 communicating with the pressure-generating chamber and ejecting droplets of the photocurable ink composition, and a pressure-generating member 10 varying the pressure in the pressure-generating chamber (see FIG. 9). The liquid-ejecting head 2 can include an ink chamber 13 and a nozzle plate 14. FIG. 9 shows an example of such a liquid-ejecting head 2. In the embodiment, the pressure-generating chamber of the head may contract when the waveform voltage increases or may contract when the waveform voltage decreases. The nozzle preferably has a diameter of 15 to 30 μm. The meniscus is the ink surface at the nozzle end.

The pressure-generating chamber preferably has a volume of $3.0\times10^6$ to $10.0\times10^6$ $\mu m^3$ and more preferably $4.4\times10^6$ to $4.5\times10^6$ $\mu m^3$. The pressure-generating chamber having a volume within such a range tends to have higher discharge stability.

The pressure-generating member may be any means that varies the pressure in the pressure-generating chamber, and examples thereof include a piezoelectric system and a thermal system.

Ejection Pulse-Generating Unit

The ejection pulse-generating unit 12 generates an ejection pulse for driving the pressure-generating member 10. The pulse of the present invention allows an ink droplet having a relatively high viscosity and a low weight to be discharged at a certain speed. As a result, provided is an ink jet recording apparatus showing excellent discharge stability such as reduced dot omission and curved flight and showing an excellent curing property by irradiation with ultraviolet light in the presence of water or a solvent. In examples of the ejection pulse shown in FIGS. 2 to 8, the volume of the pressure-generating chamber increases with an increase in the voltage. The ejection pulse may be one in which the volume of the pressure-generating chamber decreases with an increase in the voltage, depending on the liquid-ejecting head and the ejection pulse-generating unit.

FIGS. 2 to 8 are graphs showing ejection pulses used in examples and comparative examples. The vertical axis represents the relative proportion of a voltage level determined based on the assumption that the level of voltage Vha after the change by the first voltage-changing factor is 100%. The horizontal axis represents the time in microseconds. As shown in FIGS. 2 to 8, each ejection pulse includes first voltage-changing factor A, second voltage-changing factor B, third voltage-changing factor C, and fourth voltage-changing factor D. The pressure-generating member expands the volume of the pressure-generating chamber by the first voltage-changing factor A to pull a meniscus into the nozzle. The pressure-generating member contracts the volume of the pressure-generating chamber by the second voltage-changing factor B after the first voltage-changing factor A to push the meniscus from the nozzle. On this occasion, the liquid ink composition pushed from the nozzle leaves a tail, and the tail portion is in connection with the ink composition inside the nozzle by the surface tension.

Subsequently, the pressure-generating member causes a volume-expanding change by the third voltage-changing factor C to expand the pressure-generating chamber and then causes a volume-contracting change by the fourth voltage-changing factor D to contract the pressure-generating chamber. An ink droplet is thus discharged from the nozzle by the ejection pulse including from the first voltage-changing factor to the fourth voltage-changing factor. Consequently, the tail portion of the pushed ink composition is cut (separated) from the ink composition inside the nozzle, and an ink droplet can be discharged toward a recording medium. As a result, an ink droplet having a low weight can be more smoothly discharged without reducing the speed of discharging the ink droplet. In particular, such an effect is significant in the photocurable ink composition containing a polymerizable functional group-containing compound and water. Furthermore, even if the ink composition contains the polymerizable functional group-containing compound described below in an amount of 10% by mass or more in order to achieve a higher curing property, the discharge speed is prevented from decreasing when an ink droplet having a low weight is discharged. A high discharge speed and a high curing property can be achieved at the same time. When the ink composition of the embodiment is ejected as an ink droplet by means of the ejection pulse, excellent discharge stability is also achieved. In addition, in the ink composition of the embodiment, the viscosity tends to be locally increased by drying of the ink surface that is in contact with air. In the case of using such an ink composition, the ink in a meniscus is locally thickened, resulting in a tendency of decreasing the discharge stability. However, in the embodiment, it is assumed that the ink in a meniscus is vibrated by the pulse to achieve further excellent discharge stability. When the ink composition contains a polymerizable functional group-containing compound at least as an emulsion or as a polymerizable functional group-containing water-soluble compound, the curing property and the discharge stability of the ink composition can be further enhanced by using the ejection pulse of the embodiment.

The ejection pulse preferably includes a first hold factor A' for holding the voltage of the first voltage-changing factor for a certain period of time between the first voltage-changing factor A and the second voltage-changing factor B. This stabilizes the change in volume of the pressure-generating chamber by a change in the voltage and also stabilizes the variation of the meniscus of the ink droplet to be discharged. Consequently, more excellent discharge stability tends to be achieved. The holding time of the first hold factor A' is preferably 3.0 μs or less, more preferably 2.0 μs or less, and most preferably 1.5 μs or less. The lower limit of the holding time of the first hold factor A' is not particularly limited and is preferably 0.5 μs or more. This can stabilize the change in volume of the pressure-generating chamber and suppress the vibration of the meniscus of the ink composition to be discharged, resulting in a tendency of achieving further excellent discharge stability.

The ejection pulse preferably includes a third hold factor C' for holding the voltage of the third voltage-changing factor for a certain period of time between the third voltage-changing factor C and the fourth voltage-changing factor D. This separates an ink droplet to be discharged, which is believed to be in connection with a meniscus at the time, from the meniscus and discharges the ink droplet without decreasing the speed, resulting in a tendency of achieving further excellent discharge stability. The holding time of the third hold factor C' is preferably 1.5 μs or less and more preferably 1.0 μs or less. The lower limit of the holding time of the third hold factor C' is not particularly limited and is preferably 0.5 μs or more.

The voltage Vha is preferably 24 V or less, more preferably 20 V or less, and most preferably 19 V or less. The lower limit of the voltage Vha is not particularly limited and is preferably 15 V or more. A voltage Vha of 24 V or less can decrease the mass of an ink droplet to be discharged without decreasing the discharge speed (Vm) of the ink droplet. This allows printing with a high resolution and maintaining of high discharge stability.

The voltage variation (ΔVha) in the first voltage-changing factor A is preferably 10 to 30 V, more preferably 15 to 25 V, and most preferably 20 to 15 V. A variation ΔVha within such a range secures the discharge speed of an ink droplet, resulting in a tendency of achieving further excellent discharge stability.

The voltage variation (ΔVha) in the first voltage-changing factor A and the voltage variation (ΔVhc) in the third voltage-changing factor C preferably satisfy the requirement represented by Expression (C): $\Delta Vhc/\Delta Vha \geq 0.1$. The ratio of ΔVhc to ΔVha (ΔVhc/ΔVha) is more preferably 0.3 or more and most preferably 0.4 or more. The upper limit of the ratio of ΔVhc to ΔVha (ΔVhc/ΔVha) is not particularly limited and is preferably 1.0 or less. This condition secures the discharge speed of an ink droplet, resulting in a tendency of achieving further excellent discharge stability.

The voltage variation (ΔVhb) in the second voltage-changing factor B and the voltage variation (ΔVhc) in the third voltage-changing factor C preferably satisfy the requirement represented by Expression (A): $\Delta Vhc/\Delta Vhb \geq 0.5$. The ratio of ΔVhc to ΔVhb (ΔVhc/ΔVhb) is more preferably 0.6 or more and most preferably 0.65 or more. The upper limit of the ratio of ΔVhc to ΔVhb (ΔVhc/ΔVhb) is not particularly limited and is preferably 1.0 or less. This condition secures the discharge speed of an ink droplet, resulting in a tendency of achieving further excellent discharge stability.

The voltage variation (ΔVha) in the first voltage-changing factor A and the voltage variation (ΔVhb) in the second voltage-changing factor B preferably satisfy the requirement represented by Expression (B): $\Delta Vhb/\Delta Vha \geq 0.7$. The ratio of ΔVhb to ΔVha (ΔVhb/ΔVha) is more preferably 0.5 or more and most preferably 0.6 or more. The upper limit of the ratio of ΔVhb to ΔVha (ΔVhb/ΔVha) is not particularly limited and is preferably 1.0 or less. This condition secures the discharge speed of an ink droplet, resulting in a tendency of achieving further excellent discharge stability.

The change in volume of the pressure-generating chamber by the third voltage-changing factor C is preferably smaller than the change in volume of the pressure-generating chamber by the first voltage-changing factor A. This condition not only separates an ink droplet to be discharged from the meniscus but also prevents an excess application of a pressure in the direction opposite to the direction in which the ink droplet is discharged and thereby prevents a decrease in discharge speed of the ink droplet, resulting in a tendency of achieving further excellent discharge stability.

The mass of an ink droplet to be discharged is preferably 3.0 ng or less, more preferably 2.5 ng or less, and most preferably 2.0 ng or less. The lower limit of the mass of an ink droplet is preferably 0.5 ng or more and more preferably 1.0 ng or more. This condition makes the ink droplet to be discharged small, resulting in printing with a high resolution and a tendency of achieving further excellent discharge stability. The mass of an ink droplet can be measured by the method described in an example below.

The discharge speed of an ink droplet is preferably 3.0 m/s or more, more preferably 3.5 m/s or more, and most preferably 4.0 m/s or more. The upper limit of the discharge speed is not particularly limited and is preferably 10.0 m/s or less. This condition prevents a situation that another ink droplet is drawn by, for example, static electricity of the discharge face due to a too-slow discharge speed and thereby prevented from being discharged, resulting in a tendency of achieving further excellent discharge stability. The discharge speed of an ink droplet can be measured by the method described in an example below. The discharge speed of an ink droplet can be controlled by the slope of the first voltage-changing factor A, i.e., the increase rate of voltage Vha per unit time.

The ejection pulse preferably has a frequency of 10 kHz or more, more preferably 12 kHz or more, and most preferably 14 kHz or more. The upper limit of the frequency of the ejection pulse is not particularly limited and is preferably 50 kHz or less, more preferably 30 kHz or less, more preferably 25 kHz or less, and most preferably 20 kHz or less. This allows high-speed printing with a high resolution.

Light Source

The ink jet recording apparatus preferably includes a light source. As the light source (radiation source), a mercury lamp or a gas/solid laser is mainly used. As the light source used for curing a photocurable ink composition, mercury lamps and metal halide lamps are well known. However, from the viewpoint of environmental protection, mercury-free light sources are highly demanded at present, and replacement by GaN-based semiconductor ultraviolet light-emitting devices is very useful industrially and environmentally. In addition, ultraviolet light-emitting diodes (UV-LEDs) and ultraviolet laser diodes (UV-LDs) are small in size, long in life, high in efficiency, and low in cost, and are therefore expected as light sources for photocurable ink jet recording. In particular, UV-LEDs are preferred.

Herein, an ink composition curable by irradiation with radiation having an emission peak wavelength within a range of 350 to 450 nm is preferably used. The irradiation energy is preferably 500 mJ/cm$^2$ or less, more preferably 300 mJ/cm$^2$ or less, and most preferably 200 mJ/cm$^2$ or less.

The irradiation energy is calculated by multiplying the irradiation time by the irradiation intensity. The irradiation time can be shortened by the composition of the ink composition of the embodiment. In this case, the recording speed is increased. In addition, the irradiation intensity can be decreased by the composition of the ink composition of the embodiment. In this case, reductions in the size and cost of the apparatus are achieved. In irradiation with radiation on such a case, an UV-LED is preferably used. Such an ink composition can be prepared by containing a photo-radical polymerization initiator that is decomposed by irradiation with radiation having a wavelength within the above-mentioned range and a polymerizable compound that starts polymerization by irradiation with radiation having a wavelength within the above-mentioned range. In the wavelength range mentioned above, only one emission peak may be present, or a plurality of emission peaks may be present. When a plurality of emission peaks is present in the wavelength range, the total irradiation energy of the radiation having the emission peaks within the range is the irradiation energy mentioned above.

Thus, the embodiment can provide an ink jet recording apparatus having an excellent curing property by ultraviolet irradiation in the presence of water or a solvent and having excellent discharge stability such as reduced dot omission and curved flight. The irradiation may be performed at any timing, for example, before adhesion of the photocurable ink composition to a recording medium, during the adhesion, or after the adhesion.

Heating Member

The ink jet recording apparatus preferably includes a heating member for heating a recording medium onto which ejected ink droplets adheres. The heating member can evaporate the volatile components such as water in the ink, resulting in a tendency of achieving a further excellent curing property of the ink composition. In general, unfortunately, the use of such a heating member is apt to increase faulty discharge by drying of the ink at the nozzle surface during recording. However, since the ink jet recording apparatus according to the embodiment uses the ejection pulse, satisfactory discharge stability is achieved.

The heating member is not particularly limited, and examples thereof include ceramic heaters, halogen heaters, and quartz heaters. The heating may be performed at any timing, for example, before adhesion of the photocurable ink composition to a recording medium, during the adhesion, after the adhesion, or during the entire process of before, during, and after the adhesion.

The heating temperature is preferably 40° C. or more, more preferably 45° C. or more, and most preferably 50° C. or more, from the viewpoint of the curing property. The upper limit of the heating temperature is not limited and is preferably, for example, 120° C. or less. The heating temperature is the surface temperature of the recording surface of a recording medium. The heating temperature can be measured by the method described in an example below. Photocurable ink composition The photocurable ink composition used in the embodiment contains a polymerizable functional group-containing compound and water. Such a photocurable ink composition containing water is apt to increase the viscosity when it is dried at the nozzle surface to a level significantly higher than that measured by a usual method of measuring ink viscosity. Even if such an ink composition is used, however, the ink jet recording apparatus according to the embodiment can show satisfactory discharge stability. This tendency is also obtained in the photocurable ink composition containing an emulsion.

Polymerizable Functional Group-Containing Compound

The polymerizable functional group-containing compound is not particularly limited, and examples thereof include compounds having radically polymerizable functional groups. Specifically, known monofunctional and two or more multifunctional monomers and oligomers can be used. The polymerizable compounds may be used alone or in combination of two or more. The monofunctional and two or more multifunctional monomers are not particularly limited, and examples thereof include unsaturated carboxylic acids such as (meth)acrylic acid, itaconic acid, crotonic acid, isocrotonic acid, and maleic acid; salts of the unsaturated carboxylic acids; esters, urethanes, amides, and anhydrides of the unsaturated carboxylic acids; acrylonitriles, styrenes, various unsaturated polyesters, unsaturated polyethers, unsaturated polyamides, and unsaturated urethanes. Examples of the monofunctional and two or more multifunctional oligomers include linear acrylic oligomers formed from the monomers mentioned above, such as epoxy (meth)acrylate, oxetane (meth)acrylate, aliphatic urethane (meth)acrylate, aromatic urethane (meth)acrylate, and polyester (meth)acrylate.

In particular, the photocurable ink composition preferably contains the polymerizable functional group-containing compound in state dispersed (dispersion) in the ink. The dispersion is, for example, an emulsion or a suspension. In particular, preferred is an emulsion. The ink composition containing the polymerizable functional group-containing compound in a dispersed state tends to be excellent in curing property and storage stability.

The polymerizable functional group is not particularly limited, and examples thereof include hydroxyl, amine, imine, alcohol, thiol, sulfonate, carboxylate, isocyanate, vinyl, acetylene, nitrile, urethane, acrylic, and epoxy groups. Among them, the polymerizable functional group preferably is a urethane group or an acrylic group. In such a case, the ink composition tends to have an excellent curing property. The number of the polymerizable functional group in a molecule is one or more, preferably two or more, more preferably two to ten, and most preferably two to seven.

The polymerizable functional group-containing compound is not particularly limited, and examples thereof include amphipathic compounds having hydrophilic groups and hydrophobic groups in the molecules (hereinafter, also simply referred to as "amphipathic compounds") and hydrophobic compounds not having any hydrophilic group in the molecules. The ink composition containing an amphipathic compound tends to have higher emulsifiability to water and higher adhesion to a coating film and is therefore preferred.

The amphipathic compound has a hydrophilic group and a hydrophobic group. The hydrophilic group is not particularly limited, and examples thereof include hydroxyl, amine, imine, alcohol, thiol, sulfonate, and carboxylate groups. The hydrophobic group is also not particularly limited, and examples thereof include isocyanate, vinyl, acetylene, nitrile, urethane, acrylic, and epoxy groups. The ink composition containing an amphipathic compound mentioned above tends to have higher emulsifiability to water and higher adhesion.

The amphipathic compound is not particularly limited and preferably contains at least an urethane (meth)acrylate having a weight-average molecular weight of 1000 to 10000 represented by Formula (1): $R^1$—O—(CONH—$R^2$—NHCOO—$R^2$—O)$_n$—CONH—$R^2$—NH—COO—$R^4$ (wherein, n represents a natural number of 1 to 30; $R^1$ represents a residue of a hydroxyl group-containing (meth)acrylate; $R^2$ represents a residue of a diisocyanate; $R^3$ represents a residue of a diol having a non-cyclic or cyclic hydrocarbon group having 6 to 20 carbon atoms; and $R^4$ represents a residue of a polyoxyalkylene glycol monoalkyl ether) or a crosslinked urethane (meth)acrylate having a structural unit containing the urethane (meth)acrylate. The ink composition containing such a compound tends to be excellent in emulsifiability to water and adhesion.

The term "residue" refers to the part excluding the functional group that forms a urethane bond in the structure of a material of the urethane (meth)acrylate represented by Formula (1). Specifically, in the hydroxyl group-containing (meth)acrylate, the part excluding the hydroxyl group (represented by $R^1$); in the diisocyanate, the part excluding the isocyanate group (represented by $R^2$); in the polyoxyalkylene glycol monoalkyl ether, the part excluding the hydroxyl group (represented by $R^4$).

The urethane (meth)acrylate represented by Formula (1) has a weight-average molecular weight of 1000 to 10000 and preferably 2000 to 8000. The urethane (meth)acrylate having a weight-average molecular weight within such a range has a satisfactory balance between hydrophilicity and hydrophobicity and an excellent self-emulsifying property to readily form a photocurable emulsion and also readily contains hydrophobic materials such as a photo-radical polymerization initiator and another polymerizable compound inside a micelle. This tends to further improve the curing property.

The weight-average molecular weight of the urethane (meth)acrylate represented by Formula (1) can be calculated by gel permeation chromatography (GPC). In the specification, the weight-average molecular weight is that in terms of standard polystyrene and is measured with a GPC (HLC-8220 (trade name), manufactured by TOSOH CORPORATION) connected in series with three columns: TSK-gel Super HZM-M (elimination limit molecule quantity: $4\times10^6$, molecular weight fractionation range: 266 to $4\times10^6$, number of theoretical stages: 16000 stages/column, filler material: styrene copolymer, filler particle diameter: 3 μm).

In Formula (1), n represents a natural number of 1 to 30 and is specifically determined by adjusting the weight-average molecular weight described above. Hydroxyl group-containing (meth)acrylate $R^1$ in Formula (1) is a residue of a hydroxyl group-containing (meth)acrylate. The hydroxyl group-containing (meth) acrylate is used for introducing a polymerizable group to the compound represented by Formula (1). Specifically, the hydroxyl group-containing (meth)acrylate is a compound having one or more (meth)acryloyl groups and one hydroxyl group. The (meth)acryloyl group is introduced to one terminal of the main chain of the urethane (meth)acrylate by an urethanization reaction of the hydroxyl group with one isocyanate group of the diisocyanate described below. Such introduction of at least one (meth)acryloyl group imparts photopolymerizability (photocurability) to the compound. Introduction of two or more (meth)acryloyl groups provides an advantageous effect of accelerating the rate of photopolymerization and also increasing the hardness of the cured product.

The monofunctional monohydroxy mono(meth)acrylate is not particularly limited, and examples thereof include 2-hydroxyethyl (meth)acrylate, 2-hydroxypropyl (meth)acrylate, polyethylene glycol mono(meth)acrylate, polypropylene glycol mono(meth)acrylate, and polycaprolactone mono(meth) acrylate.

The difunctional monohydroxy di(meth)acrylate is not particularly limited, and examples thereof include glycerol di(meth)acrylate.

The tri- or more functional monohydroxy poly(meth)acrylate is not particularly limited, and examples thereof include pentaerythritol tri(meth)acrylate and dipentaerythritol penta (meth)acrylate.

Among these (meth)acrylates, preferred hydroxyl group-containing (meth)acrylate is polypropylene glycol mono (meth)acrylate, and polypropylene glycol monoacrylate is more preferred. The use of these compounds tends to provide an emulsion having a lower viscosity. It is also preferred to contain at least either pentaerythritol tri(meth)acrylate or dipentaerythritol penta(meth)acrylate as the hydroxyl group-containing (meth)acrylate. The use of these compounds tends to provide an emulsion having an excellent curing property.

The hydroxyl group-containing (meth)acrylates may be used alone or in combination of two or more thereof. Diisocyanate $R^2$ in Formula (1) is a residue of a diisocyanate. The diisocyanate has two isocyanate groups.

The use of the diisocyanate in synthesis of the urethane (meth)acrylate tends to hardly increase the molecular weight and to reduce the viscosity.

The diisocyanate is not particularly limited, and examples thereof include diisocyanates having alicyclic hydrocarbon skeletons of isophorone diisocyanate, diisocyanates having aliphatic hydrocarbon skeletons of hexamethylene diisocyanate, diisocyanates having aromatic hydrocarbon skeletons of xylylene diisocyanate, tolylene diisocyanate, or diphenylmethane diisocyanate, and diisocyanates having hydrogenated aromatic hydrocarbon skeletons of hydrogenated xylylene diisocyanate or hydrogenated diphenylmethane diisocyanate.

Among these diisocyanates, preferred is at least one selected from the group consisting of isophorone diisocyanate, hexamethylene diisocyanate, hydrogenated xylylene diisocyanate, and hydrogenated diphenylmethane diisocyanate. The use of such a diisocyanate tends to prevent yellowing of a cured product of the urethane (meth)acrylate by sunlight (ultraviolet light).

The diisocyanates may be used alone or in combination of two or more thereof. The polymerizable functional group-containing compound according to the embodiment may contain not only the diisocyanate but also a polyisocyanate.

Diol Having a Non-Cyclic or Cyclic Hydrocarbon Group Having 6 to 20 Carbon Atoms $R^3$ in Formula (1) is a residue of a diol having a non-cyclic or cyclic hydrocarbon group having 6 to 20 carbon atoms. The diol is introduced for adjusting the degree of hydrophobicity of the hydrophobic sites of the urethane (meth)acrylate represented by Formula (1). The diol is selected so as to give satisfactory hydrophobicity. Specifically, one or more diols selected from the group consisting of aliphatic, alicyclic, and aromatic diols having two hydroxyl groups in a molecule are preferably used. In particular, a diol having satisfactory hydrophobicity is more preferred.

Furthermore, the diol that is suitable for controlling rigidity or flexibility of the urethane (meth)acrylate and has satisfactory hydrophobicity can be optionally selected.

The aliphatic diol is not particularly limited, and examples thereof include 1,8-octanediol, 1,9-nonanediol, 1,10-decanediol, 1,11-undecanediol, 1,12-dodecanediol, 1,13-tridecanediol, 1,14-tetradecanediol, 1,15-pentadecanediol, 1,18-octadecanediol, 1,19-nonadecanediol, 1,20-eicosanediol, polypropylene glycols (e.g., dipropylene glycol, tripropylene glycol), and aliphatic polycaprolactone diols.

The alicyclic diol is not particularly limited, and examples thereof include hydrogenated bisphenol A, ethylene oxide-modified hydrogenated bisphenol A, propylene oxide-modified hydrogenated bisphenol A, 1,4-cyclohexanediol, and tricyclodecane dimethanol.

The aromatic diol is not particularly limited, and examples thereof include biphenyl-4,4'-diol, 1,4-benzenediol, bisphenol A, ethylene oxide-modified bisphenol A, and propylene oxide-modified bisphenol A.

Among these diols, aliphatic diols and alicyclic diols are preferred. The use of such a diol tends to provide satisfactory emulsifiability to water and prevent yellowing of a cured product of the urethane (meth)acrylate by sunlight (ultraviolet light).

The diols may be used alone or in combination of two or more thereof. The polymerizable functional group-containing compound according to the embodiment may contain not only the diol but also a polyol.

Polyoxyalkylene Glycol Monoalkyl Ether $R^4$ in Formula (1) is a residue of a polyoxyalkylene glycol monoalkyl ether. The polyoxyalkylene glycol monoalkyl ether may be any polyoxyalkylene glycol having one hydroxyl group blocked with an alkyl group, and examples thereof include compounds represented by Formula (2): $HO—(CH_2CH_2O)_m—R$ (wherein, R represents an alkyl group; and m represents a natural number of 9 to 90).

The urethane (meth)acrylate synthesized using the diisocyanate having two isocyanate groups and the diol described above has a straight-chain structure in which a structure derived from the diisocyanate and a structure derived from the diol are aligned in a line and, as shown in Formula (1), has a hydrophilic site $R^4$ derived from a polyoxyalkylene glycol monoalkyl ether at one terminal and a hydrophobic site derived from a (meth)acrylate having one or more (meth) acryloyl groups and one hydroxyl group at another terminal. The urethane (meth)acrylate having such a structure has particularly excellent emulsifiability to water and can drastically decrease the viscosity of an emulsion compared to that of a known urethane (meth)acrylate emulsion.

The polyoxyalkylene glycol monoalkyl ether preferably contains an oxyethylene repeating unit. The hydrophilicity tends to be freely adjusted by controlling the chain length of the oxyethylene repeating unit. The average number of the repeating oxyethylene groups is determined by controlling the balance between hydrophilicity and hydrophobicity so as to provide satisfactory emulsifiability of the urethane (meth) acrylate to water and is preferably a natural number of 9 to 90, more preferably a natural number of 9 to 60, and most preferably a natural number of 9 to 30.

The polyoxyalkylene glycol monoalkyl ether is not particularly limited, and examples thereof include polyethylene glycol monoalkyl ethers such as polyethylene glycol monomethoxy ether and polyethylene glycol monoethoxy ether.

A polyoxyalkylene glycol monoalkyl ether containing, in addition to the oxyethylene repeating unit, another oxyalkylene repeating unit in the molecule can also be used. Such a polyoxyalkylene glycol monoalkyl ether preferably has the oxyethylene repeating unit on the terminal alkyl group side. Such a structure tends to have higher emulsifiability to water. The another oxyalkylene repeating unit is not particularly limited, and examples thereof include a polyoxypropylene structure and polyoxytetramethylene structure. The number of the repeating oxyalkylene groups can be appropriately determined in view of the hydrophilic-hydrophobic balance of the urethane (meth)acrylate.

The terminal alkyl group of the polyoxyalkylene glycol monoalkyl ether, for example, R in Formula (2), is preferably a methyl group, an ethyl group, or a propyl group and more preferably a methyl group. When the terminal alkyl group is an alkyl group having a small number of carbon atoms, the hydrophobicity tends to further decrease, and the emulsifiability tends to further increase.

The polyoxyalkylene glycol monoalkyl ethers may be used alone or in combination of two or more thereof.

The urethane (meth)acrylates may be used alone or in combination of two or more thereof. The content of the urethane (meth)acrylate is preferably 5% to 50% by mass and more preferably 10% to 40% by mass based on the total amount (100% by mass) of the ink composition in order to that a coating film of the ink composition can be formed and that coating performance such as satisfactory film strength and adhesion can be obtained as an ink composition.

Crosslinked Urethane (Meth)Acrylate

The ink composition used in the embodiment preferably contains a urethane (meth)acrylate represented by Formula (1) and/or a crosslinked urethane (meth)acrylate having the urethane (meth)acrylate as a structural unit (hereinafter, also simply referred to as "crosslinked urethane (meth)acrylate"). The ink composition containing the crosslinked urethane (meth)acrylate tends to have a higher curing property and higher storage stability of the emulsion.

Crosslinking Agent

The crosslinked urethane (meth)acrylate can be prepared by reacting an urethane (meth)acrylate represented by Formula (1) and a di- or more functional crosslinking agent. The use of the crosslinking agent can increase the molecular weight of the urethane (meth)acrylate. As a result, the ink composition tends to have a higher curing property and higher storage stability of the emulsion.

Furthermore, gelation can be prevented by performing the crosslinking reaction in an oil system (oil phase) of an O/W emulsion, not in a solvent system or a nonsolvent system (medium-free system).

The di- or more functional crosslinking agent is involved in an addition reaction with a (meth)acryloyl group and is therefore preferably hydrophobic. That is, the di- or more functional crosslinking agent preferably performs Michael addition to the (meth)acryloyl group of a urethane (meth)acrylate represented by Formula (1) in the oil phase of the emulsion formed by the amphipathic compound to form crosslinking of the urethane (meth)acrylate.

Examples of the crosslinking agent that reacts with a (meth)acryloyl group include those having thiol groups or amino groups. In particular, multifunctional thiol compounds and multifunctional amine compounds allow the reaction to promptly proceed and are therefore preferred. The multifunctional thiol compounds are more preferred.

The di- or more functional crosslinking agent is not particularly limited, and examples thereof include thiol group-containing compounds and amino group-containing compounds. In particular, mercapto group-containing compounds have low solubility to water and are readily incorporated into the oil phase during water dispersion and are therefore preferred.

The mercapto group-containing compound is not particularly limited, and examples thereof include pentaerythritol tetrakis(3-mercaptopropionate) (hereinafter, also referred to as "PEMP"), trimethylolpropane tris(3-mercaptopropionate), tris-[(3-mercaptopropionyloxy)-ethyl]-isocyanurate, tetraethylene glycol bis(3-mercaptopropionate), dipentaerythritol hexakis(3-mercaptopropionate), pentaerythritol tetrakis(3-mercaptobutyrate), and trimethylolpropane tris(3-mercaptobutyrate).

The content of the di- or more functional crosslinking agent is preferably 3% to 10% by mass and more preferably 5% to 8% by mass based on the total mass (100% by mass) of the (meth)acryloyl group-containing resin.

In the crosslinked urethane (meth)acrylate, the structural unit, i.e., the urethane (meth)acrylate represented by Formula (1), has a weight-average molecular weight within the range mentioned above. Specifically, the crosslinked urethane (meth)acrylate preferably has a weight-average molecular weight of 2000 to 8000.

The crosslinked urethane (meth)acrylates may be used alone or in combination of two or more thereof. The amphipathic compound has one or more polymerizable functional groups in a molecule. From the viewpoint of ink storage stability and curing property, the number of the polymerizable functional groups is preferably two or more, more preferably two to ten, more preferably four to seven, and most preferably five or six.

The content of the polymerizable functional group-containing compound is preferably 5% by mass or more, more preferably 10% by mass or more, more preferably 15% by mass or more, and most preferably 20% by mass or more based on the 100% by mass of the ink composition. The upper limit of the content of the polymerizable functional group-containing compound is not particularly limited and is preferably 30% by mass or less based on 100% by mass of the ink composition. A content within the range mentioned above tends to further improve the curing property of the ink composition while maintaining the low viscosity of the ink to secure high discharge stability. In particular, both excellent discharge stability and a high curing property tend to be achieved in a case of forming a recorded matter having excellent image quality by discharging low-weight ink droplets and allowing ink dots having small sizes to adhere onto a recording medium at a high density.

Photocurable Emulsion

The polymerizable functional group-containing compound preferably forms a photocurable emulsion. The term "photocurable emulsion" refers to an emulsion containing a polymerizable functional group-containing compound and capable of curing by irradiation with light. An ink composition containing a photocurable emulsion is further excellent in curing by irradiation with ultraviolet light in the presence of a solvent (in particular, water or a water-soluble organic solvent) and can effectively suppress odor. The photocurable emulsion contains a polymerizable functional group-containing compound and optionally contains another polymerizable compound and a photo-radical polymerization initiator described below. The photocurable emulsion is preferably a self-emulsifiable emulsion. The term "self-emulsifiable" refers to ability of spontaneous emulsification with interfacial chemical energy only. When the photocurable emulsion is a self-emulsifiable emulsion, the photocuring property and adhesion tend to be further improved.

The use of an amphipathic polymerizable functional group-containing compound can provide a photocurable emulsion that is stable, has further excellent dispersibility, and allows the ink composition to have a lower viscosity. It is believed that the amphipathic polymerizable functional group-containing compound constitutes a shell layer in water with the hydrophobic site facing to the core and the hydrophilic site facing to the aqueous phase in water to form micelles including the photo-radical polymerization initiator therein.

The photocurable emulsion can be produced by a person skilled in the art by appropriately improving and modifying the method performed in examples described below. The method of producing the photocurable emulsion is not particularly limited, and examples thereof include known methods such as emulsion polymerization, high-pressure emulsification, and phase inversion emulsification. The method of producing the photocurable emulsion optionally uses additives such as a known emulsifier or dispersant.

In the emulsion polymerization, an amphipathic material such as a surfactant is added to an aqueous phase, and an oil phase is added thereto to polymerize at least a part of the polymerizable functional group-containing compound. In the high-pressure emulsification, an aqueous phase, an oil phase, and an amphipathic material such as a surfactant are premixed, and the mixture is emulsified with a high-pressure emulsifying apparatus such as a homogenizer into an aqueous emulsion. In the phase inversion emulsification, an amphipathic material such as a surfactant is dissolved or dispersed in an oil phase, and an aqueous phase is added thereto to prepare an O/W type emulsion. Since a continuous phase is transferred from water to oil (phase inversion) during emulsification, it is called phase-transfer emulsification. Examples of the surfactant include, but not limited to, sodium alkylsulfonate, sodium alkylsulfate ester, sodium alkyl ether sulfate, polyoxyethylene alkyl ether, polyoxyethylene alkylphenyl ether, alkyl amino fatty acid sodium, and alkyltrimethylammonium salt.

The photocurable emulsion preferably has an average particle diameter of 30 to 2000 nm and more preferably 50 to 1000 nm. When the photocurable emulsion has an average particle diameter within the range above, the ink composition tends to have further excellent discharge stability.

The average particle size of the photocurable emulsion can be adjusted by changing the molecular size of the polymerizable functional group-containing compound. The average particle diameter of photocurable aqueous emulsion can be adjusted by a known method, for example, by appropriately improving or modifying the stirring velocity or the emulsifier during the preparation of the photocurable emulsion.

In the specification, the average particle diameter means a volume-based cumulative 50% particle diameter and is measured by dynamic light scattering. The average particle diameter can be measured with, for example, Microtrac UPA150 (trade name, manufactured by Microtrac Inc.).

When the photocurable emulsion is prepared using the polymerizable functional group-containing compound, the order of the step of forming an emulsion and the step of the crosslinking reaction is not restricted. Since gelation can be effectively prevented by performing the crosslinking reaction in an emulsion state, the crosslinking reaction is preferably performed after emulsification. The crosslinking target of the crosslinking agent is not limited to the above-described polymerizable functional group-containing compound and may be another polymerizable compound.

The ink composition containing the photocurable emulsion has a low viscosity and an excellent curing property and is photocurable in the presence of water and excellent in hydrolysis resistance. In particular, a state containing a photo-radical polymerization initiator in the photocurable emulsion can achieve an excellent curing property and performance of photocuring in the presence of a certain concentration of water, which has not been provided by known photocurable emulsions.

The mechanism that the photocurable emulsion has excellent photopolymerization (curing property) and is polymerized (cured) with light in the presence of a certain concentration of water has not been revealed, but is assumed as follows. The photocurable emulsion is, as described above, in a state of forming spherical micelles in water in such a manner that the polymerizable functional group-containing compound contains the photo-radical polymerization initiator in the core thereof. In this state, polymerization (curing) does not occur by irradiation with light. However, when a certain concentration of the photocurable emulsion is achieved by drying the ink composition applied to a recording medium, polymerization (curing) occurs by light irradiation and satisfactory adhesion to the recording medium is obtained even if water remains. This is assumed to be caused by that a reduction of water concentration allows the spherical micelles to form a lamellar layer structure holding the polymerizable compound and the photo-radical polymerization initiator therein, the photo-radical polymerization initiator inside the layer structure functions as an initiator radical when the layer structure is irradiated with light, and the initiator radical attacks the radical polymerizable group-containing compound and the acryloyl group of the urethane (meth)acrylate present in the homogeneous field to cause a chain reaction. This assumption is for explanation of the curing property of a photocurable emulsion, and does not limit the photocurable emulsion of the embodiment.

Polymerizable Functional Group-Containing Water-Soluble Compound

As the polymerizable functional group-containing compound, a polymerizable functional group-containing water-soluble compound may be used. Herein, the "water-soluble compound" is dissolved in distilled water at 25° C. at a concentration of 2% by mass or more, preferably 3.5% by mass or more, more preferably 5% by mass or more, more preferably 10% by mass or more, and most preferably 20% by mass or more. The polymerizable functional group of the water-soluble compound is preferably a (meth)acrylic group, a (meth)acrylamide group, a maleimide group, a vinylsulfone group, or an N-vinylamide group, from the viewpoint of the curing property of the ink. In particular, a (meth)acrylamide group is preferred from the viewpoint of the curing property.

The number of the polymerizable functional group in a molecule is one or more and, from the viewpoint of the curing property and storage stability of the ink, preferably two or more, more preferably two to ten, more preferably two to six, and most preferably two or three.

The ratio of the molecular weight to the number of the polymerizable functional group in a molecule (the molecular weight of the polymerizable compound/the number of the polymerizable functional group in a molecule), which is also referred to as an A value hereinafter, is preferably 175 or less, more preferably 171 or less, and most preferably 165 or less from the viewpoint of the curing property and storage stability of the ink. The lower limit of the A value is preferably 84 or more. Examples of the polymerizable functional group-containing water-soluble compound include (meth)acryloyl morpholine, butanediol mono(meth)acrylate, 2-hydroxyethyl (meth)acrylate, 2-hydroxybutyl (meth)acrylate, N,N-dimethylaminoethyl (meth)acrylate, N,N-dimethyl (meth) acrylamide, 2-hydroxyethyl vinyl ether, N-vinylformamide, N-vinyl-2-pyrrolidone, and N-vinylacetamide.

In particular, from the viewpoint of the curing property and storage stability of the ink, the polymerizable functional group-containing water-soluble compound is preferably a compound represented by Formula (A):

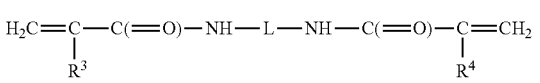

(A)

wherein, $R^3$ and $R^4$ each independently represent a hydrogen atom or a methyl group; and L represents a divalent group and includes at least any one of a C2-4 hydrocarbon group optionally substituted with one or more of hydroxyl groups, an oxygen atom, and a (meth)acryloylimino group as a structural unit.

Examples of the C2-4 hydrocarbon group optionally substituted with one or more hydroxyl groups include an ethylene group, 1,2-propylene group, 1,3-propylene group, and 1,4-butylene group. The number of the structural unit contained in a molecule is preferably one to nine and more preferably two to six. When the number is two or more, the structural units may be each independently any of the above-mentioned structural units. Examples of the compound represented by Formula (A) include, but not limited to, the following compounds.

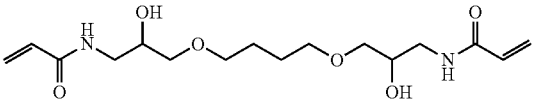

Polymerizable compound 1
A value: 172.2

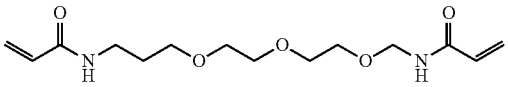

Polymerizable compound 2
A value: 164.2

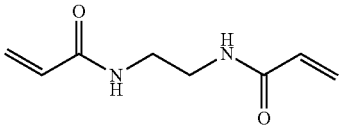

Polymerizable compound 3
A value: 84.1

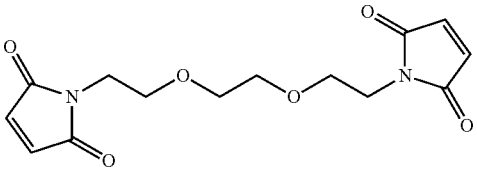

Polymerizable compound 4
A value: 154.1

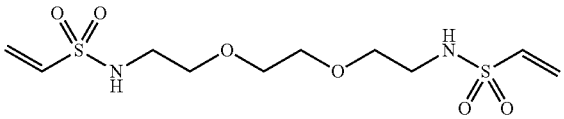

Polymerizable compound 5
A value: 164.2

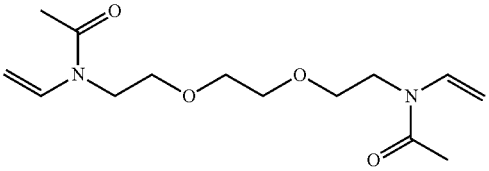

Polymerizable compound 6
A value: 142.2

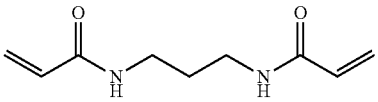

Polymerizable compound 7
A value: 91.1

-continued

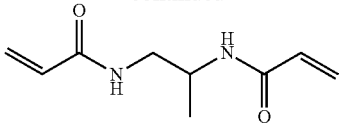

Polymerizable compound 8
A value: 91.1

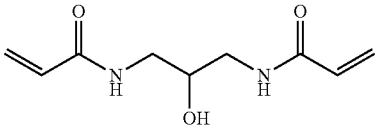

Polymerizable compound 9
A value 99.1

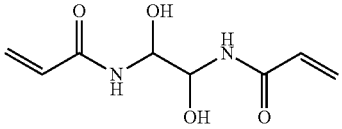

Polymerizable compound 10
A value: 100.1

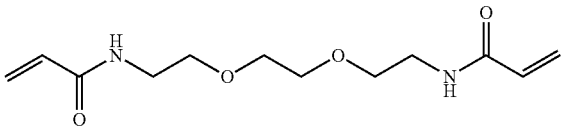

Polymerizable compound 11
A value: 128.2

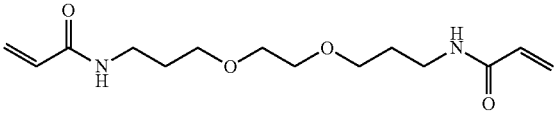

Polymerizable compound 12
A value: 142.2

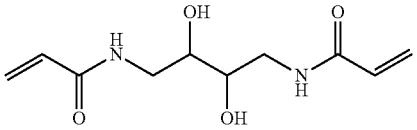

Polymerizable compound 13
A value: 114.1

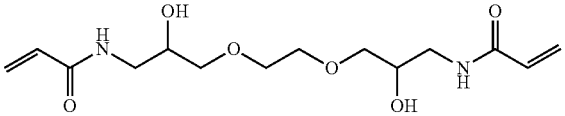

Polymerizable compound 14
A value: 158.2

Photo-Radical Polymerization Initiator

The ink composition used in the embodiment preferably contains a photo-radical polymerization initiator. The photo-radical polymerization initiator irradiated with ultraviolet light generates an active species, a radical, by the energy of the light (ultraviolet light) to initiate photopolymerization of the polymerizable functional group-containing compound. As a result, the ink present on the surface of a recording medium cures to form an image (including printing, the same shall apply hereinafter). On this occasion, the use of ultraviolet light (UV) is excellent in safety and can reduce the cost of the light source lamp.

The photo-radical polymerization initiator irradiated with active energy rays such as ultraviolet light generates radicals (photo-radical polymerization initiator radicals) through, for example, photofragmentation or hydrogen drawing, and attacks the polymerizable functional group-containing compound, for example, an urethane (meth)acrylate, a crosslinked urethane (meth)acrylate, or a compound having a radical polymerizable group (preferably, radical polymerizable (meth)acrylate) to cause photo-radical polymerization.

The ink composition may further contain the photo-radical polymerization initiator, in addition to the photocurable emulsion, or may contain the photo-radical polymerization initiator contained in the photocurable emulsion. When the photo-radical polymerization initiator is contained in the photocurable emulsion, discharge stability tends to be further improved.

Examples of the photo-radical polymerization initiator include, but not limited to, aromatic ketones, acylphosphine oxide compounds, aromatic onium salt compounds, organic peroxides, thio compounds (thioxanthone compounds and thiophenyl group-containing compounds), α-aminoalkylphenone compounds, hexaarylbiimidazole compounds, ketoxime ester compounds, borate compounds, azinium compounds, metallocene compounds, active ester compounds, compounds having carbon-halogen bonds, and alkylamine compounds.

In particular, the photo-radical polymerization initiator preferably includes at least either an acylphosphine oxide compound or a thioxanthone compound. The thioxanthone compound is used for curing the ink present on the surface of a recording medium through photopolymerization by irradiation with ultraviolet light to accomplish printing. Accordingly, the curing property of the ink composition tends to be further improved by containing the thioxanthone compound. Among radiations, the use of ultraviolet light (UV) is excellent in safety and can reduce the cost of the light source lamp. In addition, a combination of an acylphosphine oxide compound and a thioxanthone compound is excellent in the curing process with an UV-LED, and the ink composition containing the combination has a further excellent curing property.

The thioxanthone compound is not particularly limited and, specifically, preferably contains at least one selected from the group consisting of thioxanthones, diethylthioxanthones, isopropylthioxanthones, and chlorothioxanthones. The diethylthioxanthone is preferably 2,4-diethylthioxanthone, the isopropylthioxanthone is preferably 2-isopropyl thioxanthone, and the chlorothioxanthone is preferably 2-chlorothioxanthone, but they are not limited thereto. The ink composition containing such a thioxanthone compound tends to have further excellent curing property, storage stability, and discharge stability. In particular, a thioxanthone compound containing a diethylthioxanthone is preferred. The thioxanthone compound containing a diethylthioxanthone tends to further efficiently convert ultraviolet light (UV) in a wide range into active species.

Commercially available thioxanthone compounds are not particularly limited, and examples thereof include Speedcure DETX (2,4-diethylthioxanthone) and Speedcure ITX (2-isopropylthioxanthone) (manufactured by Lambson Ltd.) and KAYACURE DETX-S (2,4-diethylthioxanthone) (manufactured by Nippon Kayaku Co., Ltd.).

The acylphosphine oxide compound is not particularly limited, and examples thereof include bis(2,4,6-trimethylbenzoyl)-phenylphosphine oxide, 2,4,6-trimethylbenzoyl diphenylphosphine oxide, and bis-(2,6-dimethoxybenzoyl)-2,4,4-trimethylpentylphosphine oxide.

Commercially available acylphosphine oxide compounds are not particularly limited, and examples thereof include IRGACURE 819 (bis(2,4,6-trimethylbenzoyl)-phenylphosphine oxide) and DAROCUR TPO (2,4,6-trimethylbenzoyl diphenylphosphine oxide).

The photo-radical polymerization initiator is preferably a hydrophobic photo-radical polymerization initiator. The hydrophobic photo-radical polymerization initiator tends to be easily contained in the photocurable emulsion of the polymerizable functional group-containing compound and have further excellent emulsifiability and dispersibility.

Examples of the hydrophobic photo-radical polymerization initiator include, but not limited to, acetophenone, 2,2-diethoxyacetophenone, p-dimethylaminoacetophenone, benzophenone, 2-chlorobenzophenone, p,p'-dichlorobenzophenone, p,p'-bisdiethylaminobenzophenone, Michler's ketone, benzil, benzoin, benzoin methyl ether, benzoin ethyl ether, benzoin isopropyl ether, benzoin-n-propyl ether, benzoin isobutyl ether, benzoin-n-butyl ether, benzyl methyl ketal, 2,2-dimethoxy-1,2-diphenylethan-1-one, 1-hydroxycyclohexyl phenyl ketone, 2-hydroxy-1-{4-[4-(2-hydroxy-2-methylpropionyl)benzyl]phenyl}2-methylpropan-1-one, 2-benzyl-2-dimethylamino-1-(4-morpholinophenyl) butanone-1,2-dimethylamino-2-(4-methylbenzyl)-1-(4-morpholin-4-yl-phenyl)butan-1-one, 2,4,6-trimethylbenzoyldiphenylphosphine oxide, bis(2,4,6-trimethylbenzoyl)phenylphosphine oxide, bis(2,6-dimethoxybenzoyl)-2,4,4-trimethylpentylphosphine oxide, 2-methyl-1-[4-(methylthio)phenyl]2-morpholinopropan-1-one, thioxanthone, 2-chlorothioxanthone, 2-methylthioxanthone, 2-isopropylthioxanthone, 4-isopropylthioxanthone, 2-hydroxy-2-methyl-1-phenyl-1-one, 1-(4-isopropylphenyl)-2-hydroxy-2-methylpropan-1-one, methylbenzoyl formate, azobisisobutyronitrile, benzoyl peroxide, and di-tert-butyl peroxide.

Examples of commercially available photo-radical polymerization initiator include IRGACURE 651 (2,2-dimethoxy-1,2-diphenylethan-1-one), IRGACURE 184 (1-hydroxycyclohexyl phenyl ketone), DAROCUR 1173 (2-hydroxy-2-methyl-1-phenylpropan-1-one), IRGACURE 2959 (1-[4-(2-hydroxyethoxy)-phenyl]-2-hydroxy-2-methyl-1-propan-1-one), IRGACURE 127 (2-hydroxy-1-{4-[4-(2-hydroxy-2-methylpropionyl)-benzyl]phenyl]-2-methylpropan-1-one}, IRGACURE 907 (2-methyl-1-(4-methylthiophenyl)-2-morpholinopropan-1-one), IRGACURE 369 (2-benzyl-2-dimethylamino-1-(4-morpholinophenyl)-butanone-1), IRGACURE 379 (2-(dimethylamino)-2-[(4-methylphenyl)methyl]-1-[4-(4-morpholinyl) phenyl]-1-butanone), DAROCUR TPO (2,4,6-trimethylbenzoyldiphenylphosphine oxide), IRGACURE 819 (bis(2,4,6-trimethylbenzoyl)-phenylphosphine oxide), IRGACURE 784 (bis(η5-2,4-cyclopentadien-1-yl)-bis(2,6-difluoro-3-(1H-pyrrol-1-yl)-phenyl)titanium), IRGACURE OXE 01 (1.2-octanedione,1-[4-(phenylthio)-,2-(O-benzoyloxime]), IRGACURE OXE 02 (ethanone,1-[9-ethyl-6-(2-methylbenzoyl)-9H-carbazol-3-yl]-,1-(O-acetyloxime)), and IRGACURE 754 (mixture of oxyphenylacetic acid, 2-[2-oxo-2-phenylacetoxyethoxy]ethyl ester and oxyphenylacetic acid, and 2-(2-hydroxyethoxy)ethyl ester) (manufactured by BASF Corporation), Speedcure TPO, Speedcure DETX (2,4-diethylthioxanthone), and Speedcure ITX (2-isopropylthioxanthone) (manufactured by Lambson Ltd.), KAYACURE DETX-S (2,4-diethylthioxanthone) (manufactured by Nippon Kayaku Co., Ltd.), Lucirin TPO, LR8893, and LR8970 (manufactured by BASF Corporation), and UBECRYL P36 (manufactured by UCB Corporation).

The photo-radical polymerization initiators may be used alone or in combination of two or more thereof.

The content of the photo-radical polymerization initiator is preferably 0.1% to 10% by mass and more preferably 0.5% to 8% by mass based on the total mass (100% by mass) of the ink composition. A content within this range can achieve a sufficiently high ultraviolet curing rate and can avoid the photo-radical polymerization initiator from remaining undissolved and avoid coloring due to the photo-radical polymerization initiator.

Fluorescent Brightening Agent

The photocurable water-based emulsion preferably further contains, in addition to the photo-radical polymerization initiator, a fluorescent brightening agent. This provides a further excellent curing property.

The fluorescent brightening agent is a sensitizer and is a colorless or slightly colored compound that can absorb light having a peak wavelength at about 300 to 450 nm, ultraviolet to short-wave (visible) and can emit fluorescence having a peak wavelength at about 400 to 500 nm. The fluorescent brightening agent is also known as a fluorescent whitening agent. The physical principle and chemical property of the fluorescent brightening agent are described in Ullmann's Encyclopedia of Industrial Chemistry, Sixth Edition, Electronic Release, Wiley-VCH1998.

The fluorescent brightening agent is promoted to an excited state by active energy rays and performs interaction, such as energy transfer or electron transfer, with another material, such as a radical-generating agent or an acid-generating agent, to accelerate the generation of a useful group, such as a radical or an acid. Such interaction occurs, for example, when the energy level of the triplet excited state of a fluorescent brightening agent molecule is very close to and slightly higher than the energy level of the triplet excited state of a radical-generating agent or acid-generating agent. Practically, it is necessary that the fluorescent brightening agent can collect irradiation light of a wavelength range of 350 to 450 nm and that the energy level of the triplet excited state of the fluorescent brightening agent molecule satisfies the above-mentioned relationship with the energy level of the triplet excited state of the radical-generating agent or the acid-generating agent. Accordingly, the energy levels of the single excited state and the triplet excited state are required to be close to each other. The fluorescent brightening agent is used from the viewpoint of the interaction with the radical-generating agent or the acid-generating agent, and the absorption wavelength band of the photopolymerization initiator overlaps the absorption wavelength band of the fluorescent brightening agent from the viewpoint of efficiency of generating the radical or the acid as an ink solution at the irradiation wavelength. In this case, the fluorescent brightening agent according to the embodiment has an absorption region in a wavelength band that at least partially overlaps the absorption wavelength band in which the photopolymerization initiator is cleavable.

The fluorescent brightening agent is not particularly limited, and examples thereof include naphthalene benzoxazolyl derivatives, thiophene benzoxazolyl derivatives, stilbene benzoxazolyl derivatives, coumarin derivatives, styrene biphenyl derivatives, pyrazolone derivatives, stilbene derivatives, styryl derivatives of benzene and biphenyl, bis(benzazol-2-yl) derivatives, carbostyril, naphthalimide, dibenzothiophene-5,5'-dioxide derivatives, pyrene derivatives, and pyridotriazole. These fluorescent brightening agents may be used alone or in combination of two or more thereof.

Examples of commercially available fluorescent brightening agents include TINOPAL OB manufactured by BASF Corporation and HOSTALUX KCB (1,4-bis(2-benzoxazolyl)naphthalene) manufactured by Clariant (Japan) K.K.

The maximum absorbance of the fluorescent brightening agent at a certain concentration in a wavelength band of 360 to 420 nm is preferably higher than the maximum absorbance of the photopolymerization initiator at the same concentration in the same wavelength band. This condition tends to impart a further excellent curing property to the ink composition.

As a method of designing the photopolymerization initiator and the fluorescent brightening agent so as to satisfy the above-described characteristics, the absorption spectra of the photopolymerization initiator and the fluorescent brightening agent and the maximum absorbances thereof, i.e., peak wavelengths are analyzed. Subsequently, whether the maximum absorbances of the photopolymerization initiator and the fluorescent brightening agent satisfy the above-described relationship is investigated.

When an ultraviolet light-emitting diode (LED) is used as the light source for measuring the absorption spectra of the fluorescent brightening agent and the photopolymerization initiator, an LED having an emission peak in a wavelength band of 360 to 420 nm can be used. The number of the LED is not limited to one, and a plurality of LEDs may be combined so as to have multiple emission peaks. For example, a combination of two or more LEDs having peak wavelengths of 365 nm, 385 nm, 395 nm, and 405 nm may be used.

The fluorescent brightening agents may be used alone or in combination of two or more thereof. The content of the fluorescent brightening agent is preferably 0.01% to 0.5% by mass based on the total mass (100% by mass) of the photocurable water-based emulsion. A content within such a range provides a satisfactory photocuring property and can reduce the effect on the hue of a cured film, which is affected by the fluorescent brightening agent itself.

Water

The ink composition used in the embodiment contains water. The water is not particularly limited, and pure water such as deionized water, ultrafiltered water, reverse osmosis water, or distilled water or ultrapure water can be used. The content of water is not particularly limited and can be appropriately determined as necessary. The ink composition containing water can reduce the amount of an organic solvent to be environmentally friendly and can improve the dispersibility of the polymerizable functional group-containing compound.

The content of water is preferably 10% to 90% by mass, more preferably 20% to 80% by mass, and most preferably 40% to 80% by mass based on 100% by mass of the ink composition. A content of water within such a range can reduce the viscosity of the ink, resulting in a tendency of achieving further excellent discharge stability.

Coloring Material

The ink composition used in the embodiment may further contain a coloring material. The coloring material can be at least either a pigment or a dye.

Pigment

In the embodiment, the light resistance of the ink composition can be improved by using a pigment as the coloring material. The pigment may be any pigment that is usually used in aqueous pigment inks for ink jet recording.

The pigment is not particularly limited, and examples thereof include organic pigments such as azo pigments (e.g., azo lake, insoluble azo pigments, condensed azo pigments, and chelate azo pigments), polycyclic pigments (e.g., phthalocyanine pigments, perylene pigments, perynone pigments, anthraquinone pigments, quinacridone pigments, dioxadine pigments, thioindigo pigments, isoindolinone pigments, and quinophthalone pigments), nitro pigments, nitroso pigments, and aniline black; inorganic pigments such as carbon black (e.g., furnace black, thermal lamp black, acetylene black, and channel black), metal oxides, metal sulfides, and metal chlorides; and extender pigments such as silica, calcium carbonate, and talc.

Examples of the pigment include C.I. Pigment Yellow 64, 74, 93, 109, 110, 128, 138, 139, 150, 151, 154, 155, 180, and 185, C.I. Pigment Red 122, 202, and 209, C.I. Pigment Violet 19, C.I. Pigment Blue 15:3, 15:4, and 60, C.I. Pigment Green 7 (phthalocyanine green), 10 (green gold), 36, and 37, C.I. Pigment Brown 3, 5, 25, and 26, C.I. Pigment Orange 1, 2, 5, 7, 13, 14, 15, 16, 34, 36, 38, 64, and 71.

The pigment is preferably added to an ink as a pigment dispersion prepared by dispersing a pigment in water with a dispersant, as a pigment dispersion prepared by dispersing a surface-treated self-dispersing pigment having a hydrophilic group introduced by a chemical reaction onto the pigment particle surface in water, or as a pigment dispersion prepared by dispersing a pigment coated with a polymer in water.

The dispersant is not particularly limited, and examples thereof include polymer dispersants (agglutinate, gelatin, casein, proteins such as albumin, natural rubbers such as gum Arabic and tragacanth rubber, glucosides such as saponin, alginic acid propylene glycol esters, triethanolamine alginate, fermentation products of alginate such as ammonium alginate, cellulose derivatives such as methyl cellulose, carboxyl methyl cellulose, and ethyl hydroxyl cellulose, polyvinyl alcohols, polypyrrolidones, polyacrylic acid, acrylic resins such as acrylic acid-acrylonitrile copolymers, potassium acrylate-acrylonitrile copolymers, vinyl acetate-acrylic ester copolymers, acrylic acid-acrylic ester copolymers, and styrene-acrylic acid copolymers, styrene-acrylic resins such as styrene-methacrylic acid copolymers, styrene-methacrylic acid-acrylic ester copolymers, and styrene-m-methylstyrene-acrylic acid copolymers, styrene-maleic copolymers, styrene-maleic anhydride copolymers, vinylnaphthalene-acrylic copolymers, vinyl acetate copolymers such as vinyl acetate-ethylene copolymers, vinyl acetate-fatty acid vinyl ethylene copolymers, vinyl acetate-maleic ester copolymers, vinyl acetate-croton copolymers, and vinyl acetate-acrylic acid copolymers, and salts thereof) and surfactants (various anionic surfactants, nonionic surfactants, and amphoteric surfactants).

The surface-treated self-dispersing pigment having an introduced hydrophilic group can be dispersed or dissolved in water without a dispersant by treating the surface of the pigment such that a carboxyl group or its salt is directly bound to the surface of the pigment. Specifically, a functional group or a molecule having a functional group is grafted to the surface of a pigment by physical treatment with vacuum plasma or by chemical treatment with an oxidizing agent such as sodium hydrochloride or ozone. The functional groups that are grafted to one pigment particle may be a single type or multiple types. The type of the functional group to be grafted and the degree thereof can be appropriately determined while considering the dispersion stability in the ink, the color concentration, and the drying property at the front surface of the ink jet head.

The pigment coated with a polymer is not particularly limited. For example, the pigment can be coated with a polymer by dispersing the pigment using a dispersant having a polymerizable group and then performing emulsion polymerization using the dispersion, a copolymerizable monomer, and a photo-radical polymerization initiator in water. In particular, a preferred polymer can be prepared by polymerization of a monomer or oligomer having at least any of an acryloyl group, a methacryloyl group, a vinyl group, and allyl group as the double bond by a known method using a photo-radical polymerization initiator. The emulsion polymerization can be performed by a common method. The polymerization proceeds by free radicals generated by thermal decomposition of a water-soluble photo-radical polymerization initiator in the presence of an emulsifier.

The pigment dispersion may contain a single type or multiple types of pigments and also may contain a single type or multiple types of dispersants.

The content of the coloring material is, for obtaining an advantageous effect of forming clear images on various types of media, preferably 0.05% to 25% by mass, more preferably 0.1% to 20% by mass, more preferably 0.3% to 15% by mass, and most preferably 0.5% to 10% by mass, in terms of solid content, based on the total amount (100% by mass) of the ink composition.

Organic Solvent

The ink composition used in the embodiment may further contain an organic solvent. The organic solvent is not particularly limited, and examples thereof include alcohols such as propylene glycol, 1,2-hexanediol, and ethylene glycol, and compounds having a repeated structure of ethylene glycol, such as diethylene glycol and triethylene glycol. The ink composition containing such an organic solvent tends to have excellent moisture retention, prevent thickening due to evaporation, and have further excellent discharge stability.

Surfactant

The ink composition used in the embodiment may further contain a surfactant. The surfactant is not particularly limited, and examples thereof include siloxane surfactants such as polyether-modified organosiloxane (BYK-348, manufactured by BYK Chemie GmbH) and polyether-modified polydimethylsiloxane (BYK-333, manufactured by BYK Chemie GmbH), fluorine-based surfactants, acrylic surfactants, and acetylene glycol surfactants. The ink composition containing such a surfactant tends to sufficiently spread on the base material for printing, resulting in higher image quality.

Other Additives

The ink composition may contain an additive (component) other than the above-mentioned additives. Such an additive is not particularly limited, and examples thereof include known slip agents (surfactants), polymerization promoters, permeation promoters, wetting agents (humectants), and other additives. Examples of other additives include known fixing agents, antifungal agents, preservatives, antioxidants, UV absorbers, chelating agents, pH adjusters, and thickeners.

Other Ink Characteristics

The ink composition used in the embodiment preferably has a viscosity at 20° C. of 1 to 20 mPa·s, from the viewpoint of discharge speed and discharge stability, more preferably 1 to 15 mPa·s, more preferably 1 to 10 mPa·s, and most preferably 1 to 7 mPa·s.

Ink Jet Recoding Method

The ink jet recording method according to the embodiment is performed using an ink jet recording apparatus. Specifically, the method includes a discharge step of driving a pressure-generating member by means of a predetermined ejection pulse and thereby discharging the photocurable ink composition in the pressure-generating chamber of the ink jet recording apparatus from a nozzle, and an adhesion step of allowing the discharged photocurable ink composition to adhere to a recording medium. The ink jet recording method of the embodiment preferably includes a heating step of heating the recording medium to which the ink composition adheres and preferably includes an irradiation step of irradiating the recording medium to which the ink composition adheres with light.

Discharge Step

In the discharge step, a predetermined ejection pulse drives the pressure-generating member to discharge the photocurable ink composition in the pressure-generating chamber of the ink jet recording apparatus from the nozzle. The predetermined ejection pulse includes a first voltage-changing factor expanding the volume of the pressure-generating chamber to pull a meniscus into the nozzle, a second voltage-changing factor contracting the volume of the pressure-generating chamber to push the meniscus from the nozzle after the first voltage-changing factor, a third voltage-changing factor causing a volume-expanding change for expanding the pressure-generating chamber after the second voltage-changing factor, and a fourth voltage-changing factor causing a volume-contracting change for contracting the pressure-generating chamber after the third voltage-changing factor. Since the voltage-changing factors were already described, the explanation thereof is omitted here.

Heating Step

In the heating step, the recording medium to which the photocurable ink composition adheres is preferably heated to 40° C. or more. The heating temperature is more preferably 45° C. or more and more preferably 50° C. or more. The heating can evaporate volatile components such as water in the ink, resulting in a tendency of a further excellent curing property. The heating means is not particularly limited, and examples thereof include ceramic heaters, halogen heaters, and quartz heaters. The timing of performing the heating step is not particularly limited, and the heating is performed, for example, before the adhesion of the photocurable ink composition to a recording medium, during the adhesion, or after the adhesion and is preferably performed during the entire process of before, during, and after the adhesion. The heating temperature is the surface temperature of the recording surface of a recording medium. The upper limit of the heating temperature is not limited and is preferably, for example, 120° C. or less.

When the ink composition used in the embodiment contains at least either a photocurable emulsion or a polymerizable functional group-containing water-soluble compound, faulty discharge by drying of the ink at the nozzle surface in the heating step is prevented, resulting in a tendency of satisfactory discharge stability.

Irradiation Step

Irradiation with radiation can initiate the polymerization of the polymerizable functional group-containing compound. The photo-radical polymerization initiator contained in the ink composition is decomposed by the irradiation with radiation to generate an initiation species such as a radical, acid, or base, and the polymerization of the polymerizable functional group-containing compound is accelerated by the function of the initiation species. On this occasion, if the ink composition contains a sensitizing dye together with the photo-radical polymerization initiator, the sensitizing dye in the system absorbs active radiation and is thereby promoted to an excited state. The sensitizing dye brought into contact with the photo-radical polymerization initiator accelerates the decomposition of the photo-radical polymerization initiator to achieve the curing reaction with higher sensitivity.

As the light source (radiation source), a mercury lamp or a gas/solid laser is mainly used. As the light source used for curing the photocurable ink composition, mercury lamps and metal halide lamps are widely known. However, from the viewpoint of environmental protection, mercury-free light sources are highly demanded at present, and replacement by GaN-based semiconductor ultraviolet light emitting devices is very useful industrially and environmentally. In addition, ultraviolet light-emitting diodes (UV-LEDs) and ultraviolet laser diodes (UV-LDs) are small in size, long in life, high in efficiency, and low in cost, and are therefore expected as light sources for photocurable ink jet recording. In particular, UV-LEDs are preferred.

Herein, it is preferable to use an ink composition that can cure by irradiating with radiation having an emission peak wavelength within a range of 350 to 450 nm. The irradiation energy is preferably 500 mJ/cm$^2$ or less. Such irradiation conditions enable rapid curing with low energy consumption. The irradiation energy is calculated by multiplying the irradiation time by the irradiation intensity. Depending on the composition of the ink composition, the irradiation time can be shortened and the recording speed can be increased. In addition, the irradiation intensity can be decreased depending on the composition of the ink composition. In this case, reductions in size and cost of the apparatus are achieved. In irradiation with radiations on such a case, an UV-LED is preferably used. Such an ink composition can be prepared by containing a photo-radical polymerization initiator that is decomposed by irradiation with radiations having a wavelength within the above-mentioned range and a polymerizable functional group-containing compound that starts polymerization by irradiation with radiations having a wavelength within the above-mentioned range. The wavelength range mentioned above may include one emission peak or a plurality of emission peaks. When a plurality of emission peaks is present in the wavelength range, the total irradiation energy of the radiations having the emission peaks within the range is the irradiation energy mentioned above.

Thus, the embodiment can provide an ink jet recording method achieving an excellent curing property by ultraviolet irradiation in the presence of water or a solvent and excellent discharge stability such as reduced dot omission and curved flight. The timing of performing the irradiation step is not particularly limited and is, for example, before adhesion of a photocurable ink composition to a recording medium, during the adhesion, or after the adhesion.

EXAMPLES

The invention will now be specifically described by examples and comparative examples, but is not limited by the following examples.

Materials of Ink Composition

Main materials of ink compositions used in the following examples and comparative examples are as follows.

Materials for synthesizing amphipathic urethane acrylate

A: Hydroxyl Group-Containing Acrylate

Polypropylene glycol monoacrylate having a weight-average molecular weight of 400 (Blemmer AP400 (trade name), manufactured by NOF Corporation) (hereinafter, referred to as "PPG acrylate")

Pentaerythritol triacrylate (Aronix M-305 (trade name), manufactured by Toa Gosei Co., Ltd.)

Dipentaerythritol pentaacrylate and dipentaerythritol hexaacrylate (Aronix M-403 (trade name), manufactured by Toa Gosei Co., Ltd., dipentaerythritol pentaacrylate: 50% to 60% by mass)

B: Diisocyanate

Isophorone diisocyanate (hereinafter, also referred to as "IPDI")

C: Diol Having a Non-Cyclic or Cyclic Hydrocarbon Having 6 to 20 carbon atoms 1,12-Dodecanediol D: Polyoxyalkylene Glycol Monoalkyl Ether Methoxy PEG 400: Polyethylene glycol monomethyl ether having a weight-average molecular weight of 400 (manufactured by Toho Chemical Industry Co., Ltd.)

Methoxy PEG 1000: Polyethylene glycol monomethyl ether having a weight-average molecular weight of 1000 (manufactured by Toho Chemical Industry Co., Ltd.)

Materials for synthesizing photocurable emulsion Polymerizable functional group-containing compound (amphipathic urethane acrylate)

Amphipathic urethane acrylate a: Synthesized in synthesis example 1

Amphipathic urethane acrylate b: Synthesized in synthesis example 2

Amphipathic urethane acrylate c: Synthesized in synthesis example 3

Crosslinked Thiol

PEMP: Pentaerythritol tetrakis-3-mercaptopropionate Polymerizable functional group-containing compound (radical polymerizable acrylate)

Viscoat 802: Polypentaerythritol polyacrylate (manufactured by Osaka Organic Chemical Industry Ltd.) Urethane acrylate imparted with fixability Urethane acrylate imparted with fixability: Synthesized in synthesis example 4

Fluorescent Brightening Agent

HOSTALUX KCB: 1,4-Bis(2-benzoxazolyl)naphthalene) (manufactured by Clariant (Japan) K.K.)

Photo-Radical Polymerization Initiator

DAROCUR TPO: Acylphosphine oxide compound (manufactured by BASF Corporation)

Speedcure DETX: Thioxanthone compound (manufactured by Lambson Ltd.)

Pigment Dispersion

Cab-o-jet-260M (self-dispersing magenta pigment dispersion, solid concentration: 9.96% by mass, manufactured by Cabot Corporation)

Organic Solvent

Propylene Glycol 1,2-Hexanediol

Surfactant

BYK-348: Polyether-modified organosiloxane (manufactured by BYK Chemie GmbH)

BYK-333: Polyether-modified polydimethylsiloxane (manufactured by BYK Chemie GmbH)

Polymerizable Functional Group-Containing Compound

Photocurable emulsion a-1: Synthesized in synthesis example 5

Photocurable emulsion b-1: Synthesized in synthesis example 6

Photocurable emulsion c-1: Synthesized in synthesis example 7

Photocurable emulsion c-2: Synthesized in synthesis example 8

LR 8983: Aromatic urethane acrylate dispersion (manufactured by BASF Corporation, solid content: 40%)

Water-soluble compound d-1: Synthesized in synthesis example 9

Non-Photocurable Resin

Takelack W605 (manufactured by Mitsui Chemicals, Inc., resin emulsion, solid concentration: 30% by mass)

Preparation of Ink Composition

Synthesis of Amphipathic Urethane Acrylate

Synthesis Example 1

Synthesis of Amphipathic Urethane Acrylate (a)

A reaction vessel equipped with a stirrer, a cooling tube, a dropping funnel, and an air inlet tube was charged with 444.6 parts by mass of IPDI and 202.3 parts by mass of 1,12-dodecanediol, and 0.26 parts by mass of tin octylate was added thereto with stirring. The temperature inside the reaction vessel was raised to 90° C., followed by reaction for 1.5 hours. Subsequently, 200.0 parts by mass of methoxy PEG 400, 200.0 parts by mass of methoxy PEG 1000, and 0.42 parts by mass of tin octylate were added to the reaction mixture, followed by reaction for further 1.5 hours. Subsequently, 634.3 parts by mass of PPG acrylate, 0.84 parts by mass of methoquinone (hydroquinone monomethyl ether), and 0.67 parts by mass of tin octylate were added to the reaction vessel, followed by mixing. The temperature in the reaction vessel was raised to 85° C. under bubbling with air, followed by reaction for 3 hours. Subsequently, the reaction mixture was cooled to obtain amphipathic urethane acrylate (a) represented by Formula (1). This amphipathic urethane acrylate (a) had a weight-average molecular weight of 3200.

Synthesis Example 2

Synthesis of Amphipathic Urethane Acrylate (b)

The same reaction vessel as that used in synthesis example 1 was charged with 444.6 parts by mass of IPDI and 202.3 parts by mass of 1,12-dodecanediol, and 0.26 parts by mass of tin octylate was added thereto with stirring. The temperature inside the reaction vessel was raised to 90° C., followed by reaction for 1.5 hours. Subsequently, 200.0 parts by mass of methoxy PEG 400, 200.0 parts by mass of methoxy PEG 1000, and 0.42 parts by mass of tin octylate were added to the reaction mixture, followed by reaction for further 1.5 hours. Subsequently, 594.4 parts by mass of pentaerythritol triacrylate, 0.82 parts by mass of methoquinone, and 0.66 parts by mass of tin octylate were added to the reaction vessel, followed by mixing. The temperature in the reaction vessel was raised to 85° C. under bubbling with air, followed by reaction for 3 hours. Subsequently, the reaction mixture was cooled to obtain amphipathic urethane acrylate (b) represented by Formula (1). This amphipathic urethane acrylate (b) had a weight-average molecular weight of 3800.

Synthesis Example 3

Synthesis of Amphipathic Urethane Acrylate (c)

The same reaction vessel as that used in synthesis example 1 was charged with 444.6 parts by mass of IPDI and 202.3 parts by mass of 1,12-dodecanediol, and 0.26 parts by mass of tin octylate was added thereto with stirring. The temperature inside the reaction vessel was raised to 90° C., followed by reaction for 1.5 hours. Subsequently, 200.0 parts by mass of methoxy PEG 400, 200.0 parts by mass of methoxy PEG 1000, and 0.42 parts by mass of tin octylate were added to the reaction mixture, followed by reaction for further 1.5 hours. Subsequently, 1300.0 parts by mass of dipentaerythritol pentaacrylate, 1.17 parts by mass of methoquinone, and 0.94 parts by mass of tin octylate were added to the reaction vessel, followed by mixing. The temperature in the reaction vessel was raised to 85° C. under bubbling with air, followed by reaction for 3 hours. Subsequently, the reaction mixture was cooled to obtain amphipathic urethane acrylate (c) represented by Formula (1). This amphipathic urethane acrylate (c) had a weight-average molecular weight of 5300.

Synthesis Example 4

Synthesis of Urethane Acrylate Imparted with Fixability

The same reaction vessel as that used in synthesis example 1 was charged with 444.6 parts by mass (2 moles) of IPDI and 900.0 parts by mass (1 mole) of aromatic polyester diol (weight-average molecular weight: 900, YG-108 (trade name), manufactured by ADEKA Corporation), and 0.27 parts by mass of tin octylate was added thereto with stirring. The temperature inside the reaction vessel was raised to 85° C., followed by reaction for 2 hours. Subsequently, 232.3 parts by mass (2 moles) of 2-hydroxyethyl acrylate, 0.79 parts by mass of methoquinone, and 0.63 parts by mass of tin octylate were charged to the reaction vessel, followed by mixing. The temperature in the reaction vessel was raised to 85° C. under bubbling with air, followed by reaction for 2 hours. Subsequently, the reaction mixture was cooled to obtain urethane acrylate imparted with fixability. This urethane acrylate imparted with fixability had a weight-average molecular weight of 5000.

Preparation of Photocurable Water-Based Emulsion

A method of preparing a photocurable water-based emulsion will be described below.

Synthesis Example 5

Preparation of Photocurable Water-Based Emulsion (a-1)

The same reaction vessel as that used in synthesis example 1 was charged with 28.5 parts by mass of amphipathic urethane acrylate (a) prepared above, 9.5 parts by mass of dipentaerythritol pentaacrylate, and 2.0 parts by mass of photo-radical polymerization initiator (DAROCUR TPO). The temperature inside the vessel was raised to 80° C. with stirring and was maintained at the same temperature for 2 hours. Subsequently, the temperature inside the vessel was decreased to 50° C., and then 60 parts by mass of deionized water was added thereto with stirring. The mixture was maintained at 40° C. for 1 hour to obtain photocurable water-based emulsion (a-1) having a non-volatile content (amphipathic urethane acrylate (a), dipentaerythritol pentaacrylate, and photo-radical polymerization initiator (DAROCUR TPO)) of 40%. The composition of photocurable water-based emulsion (a-1) is shown in Table 1.

Synthesis Example 6

Preparation of Photocurable Water-Based Emulsion (b-1)

The same reaction vessel as that used in synthesis example 1 was charged with 36.7 parts by mass of amphipathic urethane acrylate (b) prepared above and 3.3 parts by mass of photo-radical polymerization initiator (DAROCUR TPO). The temperature inside the vessel was raised to 80° C. with stirring and was maintained at the same temperature for 2 hours. Subsequently, the temperature inside the vessel was decreased to 50° C., and then 60 parts by mass of deionized water was added thereto with stirring. The mixture was maintained at 40° C. for 1 hour to obtain photocurable water-based emulsion (b−1) having a non-volatile content (amphipathic urethane acrylate (b) and photo-radical polymerization initiator (DAROCUR TPO)) of 40%. The composition of photocurable water-based emulsion (b−1) is shown in Table 1.

Synthesis Example 7

Preparation of Photocurable Water-Based Emulsion (c-1)

The same reaction vessel as that used in synthesis example 1 was charged with 36.7 parts by mass of amphipathic urethane acrylate (c) prepared above and 3.3 parts by mass of photo-radical polymerization initiator (DAROCUR TPO). The temperature inside the vessel was raised to 80° C. with stirring and was maintained at the same temperature for 2 hours. Subsequently, the temperature inside the vessel was decreased to 50° C., and then 60 parts by mass of deionized water was added thereto with stirring. The mixture was maintained at 40° C. for 1 hour to obtain photocurable water-based emulsion (c−1) having a non-volatile content (amphipathic urethane acrylate (c) and photo-radical polymerization initiator (DAROCUR TPO)) of 40%. The composition of photocurable water-based emulsion (c−1) is shown in Table 1.

Synthesis Example 8

Preparation of Photocurable Water-Based Emulsion (c-2)

The same reaction vessel as that used in synthesis example 1 was charged with 21.6 parts by mass of amphipathic urethane acrylate (c) prepared above, 7.7 parts by mass of polypentaerythritol polyacrylate, 1.5 parts by mass of urethane acrylate for fixing, 5.0 parts by mass of photo-radical polymerization initiator (TPO), and 1.7 parts by mass of photo-radical polymerization initiator (DETX). The temperature inside the vessel was raised to 80° C. with stirring and was maintained at the same temperature for 2 hours. Subsequently, the temperature inside the vessel was decreased to 50° C., and then 2.5 parts by mass of crosslinking agent (PEMP) was added thereto with stirring. The mixture was stirred for 15 minutes, and 60 parts by mass of deionized water was added thereto, followed by maintaining the temperature of 50° C. for 1 hour. The temperature inside the vessel was raised to 80° C. and was maintained at the same temperature for 6 hours to obtain photocurable water-based emulsion (c-2) having a non-volatile content (amphipathic urethane acrylate (c), polypentaerythritol polyacrylate, urethane acrylate for fixing, photo-radical polymerization initiators (TPO, DETX), and crosslinking agent (PEMP)) of 40%. This emulsion was subjected to GPC, and crosslinked urethane (meth)acrylate having a weight-average molecular weight of 18000 was observed. The composition of photocurable water-based emulsion (c-2) is shown in Table 1.

Synthesis Example 9

Preparation of Water-Soluble Compound (d-1)

A 1-L three-neck flask equipped with a stirrer was charged with 40.0 g (563 mmol) of acrylamide, 57.0 g (282 mmol) of butanediol diglycidyl ether, 15.6 g (113 mmol) of potassium carbonate, 25.7 g (113 mmol) of benzyltriethylammonium chloride, and 500 mL of dioxane, followed by stirring at 90° C. for 10 hours. The resulting reaction mixture was filtered, and dioxane was distilled away under reduced pressure. To the resultant was added 200 mL of a saturated brine solution, followed by extraction with 300 mL of butanol three times. The resulting organic layer was dried over magnesium sulfate and was filtered. The solvent was distilled away under reduced pressure to obtain 58.2 g (169 mmol) of the target water-soluble compound (d-1) (yield: 60%). The water-soluble compound (d-1) is the above-described polymerizable compound 1.

The compositions of the prepared photocurable emulsions are shown in Table 1.

TABLE 1

| Photocurable emulsion | | | Synthesis example 5 a-1 | Synthesis example 6 b-1 | Synthesis example 7 c-1 | Synthesis example 8 c-2 |
|---|---|---|---|---|---|---|
| Amphipathic urethane acrylate | | Molecular structure | Linear chain | Branched chain | Linear chain | Linear chain |
| | | a (Acryloyl group: 5) | 27.50 | — | — | — |
| | | b (Acryloyl group: 6) | — | 27.50 | — | — |
| | | c (Acryloyl group: 5) | — | — | 23.30 | 21.60 |
| Crosslinked thiol | | PEMP | — | — | — | 2.50 |
| Inclusion | Radical polymerizable acrylate | Viscoat 802 | 9.20 | 9.20 | 8.30 | 7.70 |
| | Urethane acrylate imparted with fixability | | — | — | 1.70 | 1.50 |
| | Fluorescent brightening agent | HOSTALUX KCB | — | — | 0.07 | — |
| | Photo-radical polymerization initiator | DAROCUR TPO | 3.30 | 3.30 | 5.00 | 5.00 |
| | | Speedcure DETX | — | — | 1.70 | 1.70 |
| | Deionized water | | 60.00 | 60.00 | 59.93 | 60.00 |
| Total amount | | | 100.00 | 100.00 | 100.00 | 100.00 |
| Content of polymerizable functional group-containing compound | | | 36.70 | 36.70 | 33.30 | 33.30 |

*: The number of "acryloyl group" in Table 1 is equivalent to the number of the polymerizable functional group.

The above-mentioned materials and the photocurable water-based emulsions prepared in synthesis examples were mixed at the compositions (% by mass) shown in Table 2. The mixtures were each sufficiently stirred to give each ink composition.

TABLE 2

| | | Ink composition | | | | | | | | |
|---|---|---|---|---|---|---|---|---|---|---|
| | | 1 | 2 | 3 | 4 | 5 | 6 | 7 | 8 | 9 |
| Pigment dispersion | | 8.3 | 8.3 | 8.3 | 8.3 | 8.3 | 8.3 | 8.3 | 8.3 | 8.3 |
| Organic solvent | Propylene glycol | 8.0 | 8.0 | 8.0 | 8.0 | 8.0 | 8.0 | 8.0 | 8.0 | 8.0 |
| | 1,2-Hexanediol | 3.0 | 3.0 | 3.0 | 3.0 | 3.0 | 3.0 | 3.0 | 3.0 | 3.0 |
| Surfactant | BYK348 | 1.0 | 1.0 | 1.0 | 1.0 | 1.0 | 1.0 | 1.0 | 1.0 | 1.0 |
| | BYK333 | 0.3 | 0.3 | 0.3 | 0.3 | 0.3 | 0.3 | 0.3 | 0.3 | 0.3 |
| Polymerizable functional group- | a-1(36.7) | 28.0 | — | — | — | — | — | — | — | — |
| | b-1(36.7) | | 28.0 | — | — | — | — | — | — | — |

TABLE 2-continued

| | | Ink composition | | | | | | | | |
|---|---|---|---|---|---|---|---|---|---|---|
| | | 1 | 2 | 3 | 4 | 5 | 6 | 7 | 8 | 9 |
| containing compound | c-1(33.3) | — | | 31.0 | — | — | — | — | — | — |
| | c-2(33.3) | — | — | | 31.0 | 16.0 | 46.0 | — | — | — |
| | LR8983(40) | — | — | — | — | | — | 25.0 | — | — |
| | d-1(100) | — | — | — | — | — | | — | 10.0 | — |
| Non-photocurable resin | Takelack W605 (30) | — | — | — | — | — | — | — | — | 33.3 |
| Initiator | Irgacure2959 | — | — | — | — | — | — | 3.0 | 3.0 | — |
| Deionized water | | 51.4 | 51.4 | 48.4 | 48.4 | 63.4 | 33.4 | 51.4 | 66.4 | 46.1 |
| Total amount | | 100.0 | 100.0 | 100.0 | 100.0 | 100.0 | 100.0 | 100.0 | 100.0 | 100.0 |
| Content of polymerizable functional group-containing compound (%) | | 10.276 | 10.276 | 10.323 | 10.323 | 5.328 | 15.318 | 10 | 10 | 9.999 |
| Curability | | B | B | A | AA | B | AA | C | B | D |
| Storage stability | | A | B | A | A | A | A | C | C | A |

Ink Jet Recording Apparatus

A printer, PX-G930 (manufactured by Seiko Epson Corporation), was modified (hereinafter, the printer is referred to as "PX-G930 modified printer") such that ejection pulses shown in FIGS. 2 to 8 were each generated at a frequency of 20 kHz (the entire pulse is defined as one cycle), the volume of the pressure-generating chamber was $4.5\times10^6$ $\mu m^3$, a heater was attached to the platen, and the nozzle density of the head was 360 dpi. The nozzles each had a diameter of 20 μm.

In Examples and Comparative Examples, as shown in FIGS. 2 to 8, ejection pulses 1 to 5, in which the voltage variation ΔVhc and the holding time C' were different, and ejection pulses 6 and 7 not having the third voltage-changing factor were used. Other values of each pulse were as follows: Vh0 was 3 V, Vha was 20 V, and ΔVha was 17 V. Table 3 shows the parameters of each waveform.

The recording was performed by driving the head by means of any of the pulses having the above-mentioned waveforms to eject an ink with the aim of achieving a recording resolution of 2880×1440 dpi. The amount of each ink droplet was controlled so as to give an ink mass, IW, of 2.0 ng. Each ink composition was discharged with each pulse waveform. Before the discharge, a recording medium was set on the platen. The heater attached to the platen was adjusted so as to heat the surface of the recording medium to the temperature shown in the table, and the ink was discharged with heating at the target temperature.

TABLE 3

| Pulse waveform | Waveform 1 | Waveform 2 | Waveform 3 | Waveform 4 | Waveform 5 | Waveform 6 | Waveform 7 |
|---|---|---|---|---|---|---|---|
| Vh0 | 3 | 3 | 3 | 3 | 3 | 3 | 3 |
| Vha | 20 | 20 | 20 | 20 | 20 | 20 | 20 |
| Δvha | 17 | 17 | 17 | 17 | 17 | 17 | 17 |
| Vhb | 8 | 8 | 8 | 8 | 8 | 8 | 14.45 |
| ΔVhb | 12 | 12 | 12 | 12 | 12 | 12 | 5.55 |
| Vhc | 10 | 12 | 14 | 16 | 12 | 0 | 0 |
| ΔVhc | 2 | 4 | 6 | 8 | 4 | 0 | 0 |
| A'-holding time | 1.5 | 1.5 | 1.5 | 1.5 | 1.5 | 1.5 | 1.5 |
| C'-holding time | 2.6 | 1.5 | 1.5 | 1 | 2 | 0 | 0 |
| ΔVhc/ΔVhb | 0.17 | 0.33 | 0.5 | 0.67 | 0.33 | 0 | 0 |
| ΔVhb/ΔVha | 0.7 | 0.7 | 0.7 | 0.7 | 0.7 | 0.7 | 0.3 |
| ΔVhc/ΔVha | 0.12 | 0.23 | 0.35 | 0.47 | 0.23 | 0 | 0 |

Ink Jet Recording Method

Examples 1 to 14 and Comparative Examples 1 to 5

The ink compositions prepared above were each discharged with the PX-G930 modified printer by an ink jet recording method, and the followings were measured and evaluated.

Evaluation and Measurement Methods

Method of Measuring Discharge Speed Vm

The appearance of an ink droplet flying from the PX-G930 modified printer at the upper side to the recording medium at the lower side was photographed (stroboscopic photographed) from the horizontal side at a constant time interval. Within a range of distance of 0.5 to 1 mm from the nozzle, the ink droplet speed (≈Vm) was calculated from a relationship between the flight distance of an ink and the time required for flying the distance.

Method of Measuring Mass of Ink Droplet

The mass of an ink per one discharge (one ink droplet) was calculated by serially discharging the ink from a normally discharging nozzle and dividing the mass of the discharged ink by the number of times of discharging operation.

Method of Measuring Heating Temperature

The surface temperature of the face (the side facing the head) of the recording medium at the position facing the head was measured with a non-contact thermometer.

Method of Evaluating Discharge Speed

The discharge speeds measured as described above were evaluated by the following evaluation criteria. When the discharge speed Vm was slower than 3.0 m/s, the ink droplet did not land on an aimed position, and the mist of the discharged ink droplet adhered to the head to decrease the discharge stability.

A: Vm of 4.0 m/s or more

B: Vm of 3.0 m/s or more and less than 4.0 m/s

C: Vm of 2.0 m/s or more and less than 3.0 m/s

D: Vm of less than 2.0 m/s

Method of Evaluating Curing Property

Cotton swab-weighted tack was evaluated. Specifically, an ink was applied onto a PVC medium with a bar coater so as to have a film thickness of 20.61 μm, dried at 50° C. for 3 minutes, and then irradiated with ultraviolet light using an LED UV lamp. More specifically, the irradiation energy of light irradiating the coating film was increased in increments of 50 mJ/cm$^2$, and the coating film was rubbed with a cotton swab each time. The minimum irradiation energy at which the cotton swab was not colored was evaluated as curing energy. The evaluation criteria are as follows. An LED having a peak wavelength at 395 nm was defined as an irradiation intensity of 500 mw/cm$^2$.

AA: Ink-curing energy of less than 100 mJ/cm$^2$

A: Ink-curing energy of 100 mJ/cm$^2$ or more and less than 200 mJ/cm$^2$

B: Ink-curing energy of 200 mJ/cm$^2$ or more and less than 300 mJ/cm$^2$

C: Ink-curing energy of 300 mJ/cm$^2$ or more and less than 400 mJ/cm$^2$

D: Ink-curing energy of 400 mJ/cm$^2$ or more

Method of Evaluating Contamination of Nozzle Plate

After recording for 200 hours, the nozzle face was visually evaluated for contamination of the nozzle plate by the following evaluation criteria.

A: No adhesion of ink

B: Adhesion of ink to the periphery of the nozzle

C: Adhesion of ink to the entire nozzle plate

Method of Evaluating Discharge Stability

Each ink was serially discharged, for 60 minutes, onto a recording medium with heating at a temperature shown in Table 4 by operating the platen heater using the PX-G930 modified printer having a head provided with 360 nozzles aligned in one line at a nozzle density of 360 dpi. The discharge was discontinued every 10 minutes, and the discharge by each nozzle was investigated. A nozzle that did not discharge an ink or discharged an ink droplet at a position deviated from the normal landing position by 1/(360×2) inches or more was decided as being abnormal. The nozzle that was decided as being abnormal once or more in the inspection every ten minutes was judged as an abnormal nozzle.

A: No abnormal nozzle

B: One to three abnormal nozzles

C: Four or more abnormal nozzles

Method of Evaluating Storage Stability

The viscosity of each ink composition at the time of preparation and the viscosity of the ink composition stored in the atmosphere at 65° C. for 5 days were measured with an E-type viscometer (TVE-20H (trade name), manufactured by Toki Sangyo Co., Ltd.). The rate of change in viscosity was calculated from the difference between the viscosities before and after the storage, and the storage stability was evaluated by the following criteria.

A: Viscosity change rate of less than 5%

B: Viscosity change rate of 5% to 10%

C: Viscosity change rate of higher than 10%

TABLE 4

| | Example | | | | | | | | | | | | | | Comparative Example | | | | |
|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 1 | 2 | 3 | 4 | 5 |
| Ink composition | 1 | 2 | 3 | 4 | 4 | 4 | 4 | 4 | 4 | 5 | 5 | 6 | 7 | 8 | 4 | 4 | 9 | 9 | 8 |
| Curability | B | B | A | AA | AA | AA | AA | AA | AA | B | B | AA | C | B | AA | AA | D | D | B |
| Storage stability | A | B | A | A | A | A | A | A | A | A | A | A | C | C | A | A | A | A | C |
| Pulse waveform | 3 | 3 | 3 | 1 | 2 | 3 | 4 | 5 | 2 | 3 | 2 | 3 | 3 | 3 | 6 | 7 | 3 | 6 | 6 |
| Heating temperature | 50 | 50 | 50 | 50 | 50 | 50 | 50 | 50 | 40 | 50 | 50 | 50 | 50 | 50 | 50 | 50 | 50 | 50 | 50 |
| Ink droplet amount (ng) | 2.4 | 2.5 | 2.6 | 3.2 | 2.9 | 2.5 | 2.3 | 2.8 | 2.9 | 2.5 | 2.5 | 2.6 | 2.4 | 2.4 | 3.5 | 2.6 | 2.5 | 3.6 | 3.5 |
| Discharge speed | A | A | A | C | C | A | A | C | C | A | C | B | A | A | D | D | B | D | D |
| Nozzle plate pollution | A | A | A | B | B | A | A | B | B | A | A | B | A | A | C | C | B | C | C |
| Discharge stability | A | A | A | B | B | A | A | B | A | A | A | B | A | A | C | C | A | A | C |

In Examples 1 to 14 employed the pulses of the embodiment, ink droplets of small volumes could be discharged without decreasing the discharge speed with excellent discharge stability. In contrast, in Comparative Examples 1 and 5 employed pulse 6 not including the third voltage-changing factor, ink droplets of larger volumes were discharged, the discharge speed was low, and the discharge stability was inferior. In the cases of slow discharge speeds, contamination of the nozzle plate also tended to occur. It was assumed that when the discharge speed of an ink is slow, an ink droplet readily forms ink mist by influence of wind to contaminate the nozzle plate by the ink mist.

Similarly, in Comparative Example 2 employed pulse 7 not including the third voltage-changing factor, the volume of the ink droplet tended to be small, the discharge speed was slow, and the discharge stability was inferior. In both Comparative Examples 3 and 4 employed ink composition 9, which was not of the embodiment, the curing property was inferior, but in Comparative Example 3 employed the pulse of the embodiment, the discharge speed was satisfactory, whereas in Comparative Example 4 employed the pulse other than the pulses of the embodiment, the discharge speed was slow. This was the same tendency of the case using the ink of the embodiment. In contrast, in Comparative Examples 1, 2, and 5 employed the ink compositions 4 and 8 of the embodiment but the pulses 6 and 7 that were other than the pulses of the embodiment, the discharge stability tended to deteriorate, whereas in Comparative Examples 3 and 4 employed the ink composition 9 that was other than the embodiment, the discharge stability was not deteriorated. These results demonstrate that the use of the ink composition of the embodiment enhances the curing property, but that the discharge stability tended to deteriorate by using the pulse that was other than the embodiment. Thus, it was revealed that the pulse of the embodiment is particularly useful.

The discharge stability in Example 9 employed a heating temperature of 40° C. was higher than that in Example 5 employed a heating temperature of 50° C., but it was assumed that the drying of the ink adhered to the recording medium would take a longer time because of the low heating temperature. This demonstrates that in heating of a recording medium with a heating means, the discharge stability tends to be reduced, whereas the drying speed can be increased, and the invention is particularly useful. It is not shown in the table, but in Example 5, the discharge stability tended to be further excellent with an increase in frequency of the ejection pulse and was further excellent at a frequency of 10 KHz or more.

The entire disclosure of Japanese Patent Application No.: 2013-128236, filed Jun. 19, 2013 is expressly incorporated by reference herein.

What is claimed is:

1. An ink jet recording apparatus comprising:

a liquid-ejecting head including a pressure-generating chamber filled with a photocurable ink composition containing a polymerizable functional group-containing compound and water, a nozzle communicating with the pressure-generating chamber and ejecting a droplet of the photocurable ink composition, and a pressure-generating member causing a pressure change in the pressure-generating chamber; and an ejection pulse-generating unit generating an ejection pulse for driving the pressure-generating member, wherein the ejection pulse includes:

a first voltage-changing factor expanding the volume of the pressure-generating chamber to pull a meniscus into the nozzle;

a second voltage-changing factor contracting the volume of the pressure-generating chamber to push the meniscus from the nozzle after the first voltage-changing factor;

a third voltage-changing factor causing a volume-expanding change for expanding the pressure-generating chamber after the second voltage-changing factor; and a fourth voltage-changing factor causing a volume-contracting change for contracting the pressure-generating chamber after the third voltage-changing factor, and the ink droplet is discharged from the nozzle by means of the ejection pulse.

2. The ink jet recording apparatus according to claim 1, wherein the second voltage-changing factor and the third voltage-changing factor respectively give a voltage variation ($\Delta Vhb$) and a voltage variation ($\Delta Vhc$) satisfying Expression (A): $\Delta Vhc/\Delta Vhb \geq 0.5$.

3. An ink jet recording method using an ink jet recording apparatus according to claim 2.

4. The ink jet recording apparatus according to claim 1, wherein the polymerizable functional group-containing compound has a content of 10% by mass or more based on 100% by mass of the photocurable ink composition.

5. An ink jet recording method using an ink jet recording apparatus according to claim 4.

6. The ink jet recording apparatus according to claim 1, wherein the photocurable ink composition contains the polymerizable functional group-containing compound at least as an emulsion or as a polymerizable functional group-containing water-soluble compound.

7. An ink jet recording method using an ink jet recording apparatus according to claim 6.

8. The ink jet recording apparatus according to claim 1, wherein the ejection pulse includes a third hold factor for holding the voltage of the third voltage-changing factor for a certain period of time between the third voltage-changing factor and the fourth voltage-changing factor; and the third hold factor has a holding time of 1.5 μs or less.

9. An ink jet recording method using an ink jet recording apparatus according to claim 8.

10. The ink jet recording apparatus according to claim 1, wherein the first voltage-changing factor and the second voltage-changing factor respectively give a voltage variation ($\Delta Vha$) and a voltage variation ($\Delta Vhb$) satisfying Expression (B): $\Delta Vhb/\Delta Vha \geq 0.7$.

11. An ink jet recording method using an ink jet recording apparatus according to claim 10.

12. The ink jet recording apparatus according to claim 1, wherein the change in volume of the pressure-generating chamber by the third voltage-changing factor is smaller than the change in volume of the pressure-generating chamber by the first voltage-changing factor.

13. An ink jet recording method using an ink jet recording apparatus according to claim 12.

14. The ink jet recording apparatus according to claim 1, wherein the ejection pulse includes a first hold factor for holding the voltage of the first voltage-changing factor for a certain period of time between the first voltage-changing factor and the second voltage-changing factor.

15. An ink jet recording method using an ink jet recording apparatus according to claim 14.

16. The ink jet recording apparatus according to claim 1, wherein the ink droplet has a mass of 3.0 ng or less.

17. The ink jet recording apparatus according to claim 1, wherein the ink droplet is discharged at a discharge speed of 3.0 m/s or more.

18. The ink jet recording apparatus according to claim 1, wherein the ejection pulse has a frequency of 10 kHz or more.

19. The ink jet recording apparatus according to claim 1, further comprising a heating member for heating a recording medium to which the ejected ink droplet adheres.

20. An ink jet recording method using an ink jet recording apparatus according to claim 1.

* * * * *